US009700122B2

(12) United States Patent
Pelland et al.

(10) Patent No.: US 9,700,122 B2
(45) Date of Patent: Jul. 11, 2017

(54) CENTRAL OSTEOARTICULAR RELIEF AND PERFORMANCE STRUCTURED LOAD DISTRIBUTION SYSTEM DEVICE AND MODULAR SCALABLE VEST SYSTEM

(71) Applicant: DEPARTMENT OF THE NAVY, U.S. MARINE CORPS, Quantico, VA (US)

(72) Inventors: James Leon Pelland, Quantico, VA (US); Paul Melvin Lee, III, Fredericksburg, VA (US); Timothy Tyler Merica, Bozeman, MT (US); Barbara Jean Quinn, Framingham, MA (US); Trevor Humphrey Scott, Boston, MA (US); Brian Wilbur Robie, Charlestown, NH (US); Derrick Emmett Dillon, Manhattan, MT (US); William Francis Carney, Fredericksburg, VA (US); John Anthony Kirejczyk, Marlborough, MA (US)

(73) Assignee: DEPT. OF THE NAVY, A U.S. GOVERNMENT AGENCY, BY THE U.S. MARINE CORPS, Washington, DC (US)

( * ) Notice: Subject to any disclaimer, the term of this patent is extended or adjusted under 35 U.S.C. 154(b) by 397 days.

(21) Appl. No.: 14/313,476

(22) Filed: Jun. 24, 2014

(65) Prior Publication Data

US 2014/0305982 A1 Oct. 16, 2014

(51) Int. Cl.
*A45F 3/08* (2006.01)
*A45F 3/06* (2006.01)
(Continued)

(52) U.S. Cl.
CPC ..... *A45F 3/06* (2013.01); *A45F 3/08* (2013.01); *F41H 1/02* (2013.01); *A41D 2400/48* (2013.01);
(Continued)

(58) Field of Classification Search
CPC ..... A45F 3/14; A45F 3/06; A45F 3/08; A45F 2003/045; A45F 2003/146
(Continued)

(56) References Cited

U.S. PATENT DOCUMENTS 1,316,915 A * 9/1919 Steinert ..... A61F 5/028 602/19
4,771,767 A * 9/1988 Steffee ..... A61B 17/7002 606/256
(Continued)

OTHER PUBLICATIONS

MR Zing; Carry Innovation:: Interview with Vertepac; Webpage; Nov. 6, 2014. www.carryology.com/bags/interview-vertepac/.

*Primary Examiner* — Lester L Vanterpool
(74) *Attorney, Agent, or Firm* — Timothy Slabouz; Sally Ferrett

(57) ABSTRACT

The present invention is a loadbearing device known by the Applicants' as the "Central Osteoarticular Relief and Performance Structured Load Distribution System" ("CORPS-LDS"), which is worn by a user to help distribute the weight of a load being carried or borne by the user. More specifically, the weight is substantially shifted from the user's shoulders to their hips while not overly inhibiting the user's range of motion. Furthermore, it is an aspect of the CORPS-LDS to distribute the weight being carried in a manner that reduces the strain on the spine and back while lessening the metabolic expenditure of the user. Moreover, the present invention is a protective vest system that utilizes the present invention's CORPS-LDS.

18 Claims, 18 Drawing Sheets

(51) Int. Cl.
*F41H 1/02* (2006.01)
*A45F 3/04* (2006.01)
*A45F 3/14* (2006.01)

(52) U.S. Cl.
CPC ... *A45F 2003/045* (2013.01); *A45F 2003/146* (2013.01)

(58) Field of Classification Search
USPC ..... 224/576, 261, 262
See application file for complete search history.

(56) References Cited

U.S. PATENT DOCUMENTS

| | | | | |
|---|---|---|---|---|
| 4,911,346 | A * | 3/1990 | Shallman | A45F 3/08 224/153 |
| 5,676,701 | A * | 10/1997 | Yuan | A61L 27/045 606/247 |
| 6,185,738 | B1 | 2/2001 | Sidebottom | |
| 8,182,439 | B2 | 5/2012 | Glenn | |
| 8,572,762 | B2 | 11/2013 | Herbener et al. | |
| 9,370,237 | B2 * | 6/2016 | Hiemenz | A45F 3/04 |
| 2003/0050581 | A1 * | 3/2003 | Berns | A41D 13/0531 602/3 |
| 2010/0263111 | A1 * | 10/2010 | Leatt | A41D 13/0512 2/467 |
| 2012/0131736 | A1 * | 5/2012 | Reimer | A41D 13/0531 2/467 |

* cited by examiner

Figure 12a
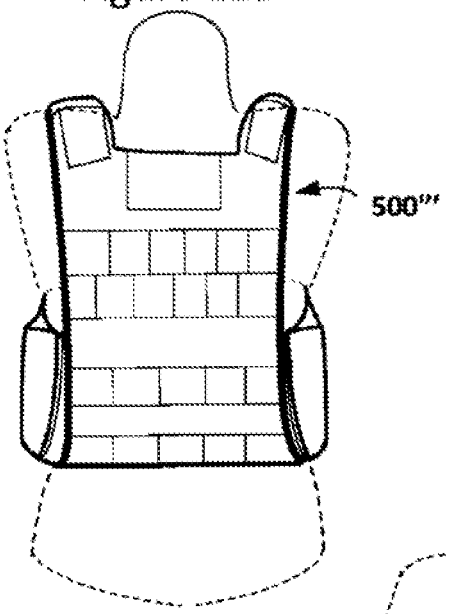
Figure 12c
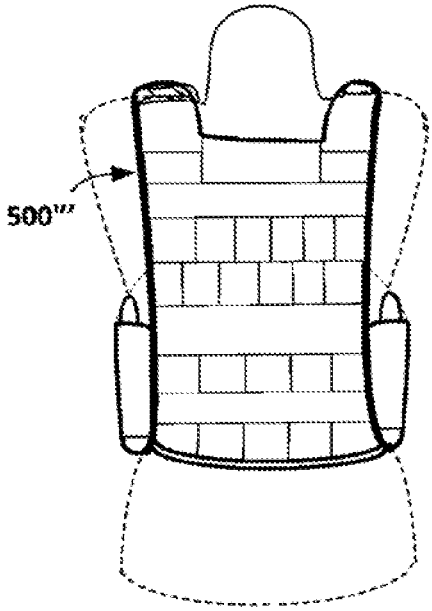
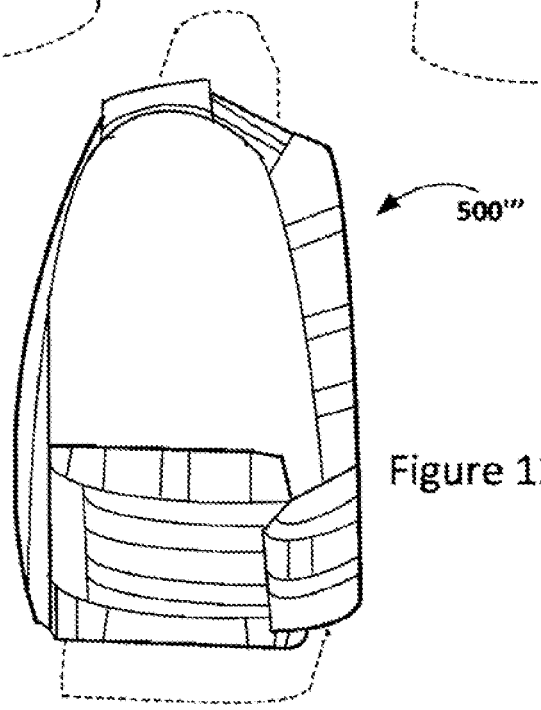
Figure 12b

CENTRAL OSTEOARTICULAR RELIEF AND PERFORMANCE STRUCTURED LOAD DISTRIBUTION SYSTEM DEVICE AND MODULAR SCALABLE VEST SYSTEM

STATEMENT REGARDING FEDERALLY SPONSORED RESEARCH OR DEVELOPMENT

The invention described herein may be manufactured and used by or for the Government of the United States of America for any purpose whatsoever without payment of any royalties thereon or therefor.

CROSS REFERENCE TO RELATED APPLICATIONS

This non provisional incorporates by reference the entire contents of the prior provisional application No. 61/894,059, filed Oct. 22, 2013, and all related submittals are hereby incorporated by reference for all purposes as if fully set forth herein.

COPYRIGHT NOTICE

A portion of the disclosure of this document may contain materials that are subject to copyright protection. The copyright owner has no objection to the facsimile reproduction by anyone of this document or disclosure as it appears in the Patent and Trademark Office patent file or records, but otherwise reserves all copyright rights whatsoever.

REFERENCE TO A SEQUENCE LISTING, A TABLE, OR A COMPUTER PROGRAM LISTING COMPACT DISK APPENDIX

N/A

BACKGROUND OF THE INVENTION

1. Field of the Invention

The present invention is directed, in general, to a device and system capable of shifting at least some of the weight of a user-borne load from the user's upper body to the user's hips/pelvic area; and, more specifically, relates to a load distribution device that can be used without limitation, with a tactical vest system or protective clothing used by military and police/protective forces personnel; or, without limitation, packs, backpacks, or carriers commonly used by students, hikers, campers and other outdoor enthusiasts, or in other fields of use, without limitation, where a load may be shifted from the user's shoulders to the user's hips/pelvic area.

2. Description of the Background Art

Military and law enforcement personnel are often required to wear tactical vests or protective clothing (hereinafter tactical vests and/or protective clothing may be referred to as a "vest" or "vests"), which are often heavy in the first instance, and made even heavier because of the incorporation or use of armor or other protective plating or materials (hereinafter either will be referred to as "Plates" or "SAPI Plates" and can include an enhanced plate variant known as ESAPI Plates). Moreover, the load that is being supported or carried by the wearer is frequently increased even further due to the addition or carrying of equipment items or gear attached to such vests.

There are many different versions of vests, many of which have been available and used by military and law enforcement personnel for years. An example of a protective vest is described in U.S. Pat. No. 6,185,738 ("Pat. '738"). In general, the protective vest, as described in Pat. '738, provides improved load-bearing features, and is adaptable to a user's tactical and ballistic characteristics. However, the "load-bearing" described in Pat. '738 is, in general, the provision of adaptations used to "carry" detachable elements such as supply receptacles and other auxiliary items. Therefore, while many vests are capable of carrying items that comprise a portion of the load being supported by the user, and, as described in Pat. '738, are securely attached to the user through a variety of means such as belts, straps, and etc., the weight of the vest and equipment is, in general, predominantly borne by the user's shoulders and back, which is a factor that can lead to physical distress, may limit mobility, and/or can cause injuries.

From another perspective, to accommodate load bearing, typical loadbearing frames used in hiking equipment (e.g., hiking packs) utilize a rigid frame-like structure which, due to the attachment of the rigid frame-like structure to a load bearing waist belt, prohibits freedom of movement such as bending over at the waist, twisting and bending side to side.

An example of a body support system is shown in, U.S. Pat. No. 8,182,439 ("U.S. Pat. No. '439"). In general, the patent states that this support system relates to support garments and in particular to body support systems that transfer back and spinal loading to the hips and legs of a user and may incorporate body armor or other load attaching features. While this system might be useful, it is Applicant's belief that the '439 system has the following limitations and/or does not meet several needs: a lack of flexibility in the vertical frame; it does not mimic natural movements of the human spine; there appears to be a limited capability to bend forward at hips and to twist at the torso, and to allow for bending side-to-side; it is worn next to the user; and it is not capable of being rapidly released and/or not capable of being easily dismantled.

An example of a device and system for supporting at least some of the weight of a heavy vest by distributing the weight off of the user's shoulders, neck, and back to at least the user's hips is described in U.S. Pat. No. 8,572,762 ("U.S. Pat. No. '762"). In general, this load distribution device comprises a back brace; a multi-element belt; and a coupling used to connect the back brace to an element of the belt, and when combined and properly oriented with a vest may form a weight distribution system.

While the device and/or system of '762 and/or '439 may provide a weight distribution and support device and system for armor vests that may redistribute weight off of the shoulders of the user, it is the Applicants' belief that there is still a present need to provide a weight redistribution device and system that provides a modular scalable vest system that includes, without limitation, a device that provides improved weight redistribution characteristics; provides the user with an improved range of motion; and provides a quick-release feature that allows a user the means to quickly separate components for tactical or other purposes.

SUMMARY OF THE INVENTION

In general, the Modular Scalable Vest (hereinafter referred to as the "MSV" or "Vest") is the United States Marine Corps' first product of the new system of systems approach utilized for body armor design. The MSV provides a modular scalable design that replaces the multiple vest strategy with a single, tailorable system that scales from a low-visibility vest up to a level of utility and/or protective coverage similar to that of the Marine Corps "Improved Modular Tactical Vest." A part of the present invention, and, therefore, as a part of the MSV system, is a load distribution device that enhances Warfighter mobility and reduces Warfighter fatigue by providing an improved system of distributing weight from the user's shoulders to the user's hips/pelvic area.

According to the present invention, variations of the MSV are or may be comprised of at least some, if not all, of the following items: the Fighting Vest (or Jacket), MSV Plate Carrier ("MSV PC"), the CORPS Load Distribution System ("CORPS-LDS"), the Leatherneck Guard, and the Tier-2 Protective Over Garment ("Tier-2 POG"). The various components can be removed or added to construct multiple combat suites (i.e., a group of items forming a system) of varying utility and/or armor protection levels ("APL"). The MSV, at a minimum, provides at least the same level of ballistic and fragmentation protection as the current armor systems while, without limitation, providing the important features of improved warfighter mobility and reduced physical exertion, i.e., lessened metabolic expenditure.

What could be described as a primary feature of at least one configuration of the MSV system is the present invention's load distribution device, which is named by the Applicants' as the "Central Osteoarticular Relief and Performance Structured Load Distribution System" (herein referred to as the "CORPS-LDS"). The CORPS-LDS is worn by a user to help distribute the weight of the Vest/MSV PC and equipment worn by the user from the user's shoulders to their hips and/or pelvis while not overly inhibiting the user's range of motion.

For ease of explanation, the CORPS-LDS portion of the MSV/MSV PC will now be more fully described. Specifically, according to the present invention, the CORPS-LDS is comprised of four major sections: (1) the "1775 Frame Sheet"; (2) the articulating loadbearing or load distributing spine (hereinafter referred to as the "Spine"), which, in general, can be described, and/or functions, as an external, articulating spinal column (that mimics some of the functionality of a human spine); (3) the CORPS-LDS belt attachment bracket (hereinafter referred to as the "Belt Bracket"); and (4) the "CORPS Belt." More specifically, the 1775 Frame Sheet is designed (e.g., the 1775 Frame Sheet has sections that preferably rest on or in the area near a user's upper torso and/or shoulders) and is manufactured to provide structure and support for the CORPS-LDS in at least the area on or about the user's upper torso and/or shoulders. This design allows the invention to initiate the transfer of the load of a Vest/MSV PC including, but not limited to, the weight of Plates, soft armor, and vest materials to and/or through the Spine and, thereby, assists in facilitating the load distribution feature of the present invention. Moreover, the design of at least the upper portion of the 1775 Frame Sheet, which includes extensions that can fit within the back section of the MSV PC on or in the proximity of a user's shoulder area, can provide for the transfer of at least some of the load from the front of the Vest/MSV PC (including the Vest materials, ballistic protection plate(s) and items connected to the front of the Vest) to the Spine and the user's hips or pelvic region. In other words, the design of the 1775 Frame Sheet including these 1775 Frame Sheet extensions provide a means to, when properly adjusted, carry the load of the Vest/MSV PC from, or off of, the user's shoulders through the 1775 Frame Sheet to and through the Spine to the CORPS Belt. The CORPS-LDS 1775 Frame Sheet, in its current configuration, is made of, but is not limited to, a wood core with a carbon-fiber wood laminate. It is apparent from the design that other materials could be used for the 1775 Frame Sheet construction as long as they are preferably, but without limitation, lightweight and strong enough to bear the load of the Vest/MSV PC.

According to the present invention, the Spine is, in general, comprised of at least one "vertebra" (which, in general, may be characterized as having features of, or which essentially form, a ball-and-socket joint (or joint-like structure)). Preferably, but without limitation, each "vertebra" has three holes or apertures with one located in the center (i.e., through the center of the "ball-and-socket"), and one on each of the left and right sides of each of the "vertebra." These apertures are primarily used for the purpose of creating open channels through the Spine when more than one "vertebra" is used, i.e., "stacked," to form the Spine. More, specifically, each "vertebra" is preferably comprised of, but not limited to, an individual plastic and rubber component, which are preferably, but without limitation, also comprise a ball-and-socket joint structure and are flexibly joined to each other using the aforementioned ball-and-socket joint feature. And, preferably, when a number of "vertebra" are stacked on top of each other (similar to the "stacking" of human vertebra) the ball-and-socket feature in conjunction with the use of a cable or tube running through the central channel of the "vertebra" stack, and cables or tubes inserted into and running through the left and right side channels, work together to essentially provide the invention's flexible and rotatable features while still providing overall stability for the "stack" structure. More specifically, but without limitation, in one embodiment of the invention, running through the left and right side, i.e., the outer, channels of the Spine are rubber, rubber-like, semi-rigid or flexible tubes that ensure that the Spine elements, preferably comprising a stack of (i.e., more than one) "vertebra," remain engaged and prevents over-rotation of the Spine (and/or elements comprising the Spine) while being capable of transferring load to the CORPS Belt, and, it is Applicants' belief that, at the same time, assists in providing the user with a superior rotational and bending feature and capability. Still more specifically, a preferred characteristic of the preferably, but without limitation, plastic component of each "vertebra" is that this plastic component provides compression strength and stiffness for Spine stability while only adding a minimal amount of weight, and a preferred characteristic of the, preferably, but without limitation, rubber component is that the rubber component provides the ability to compress and stretch which allows for rotation and/or twisting of the Spine assembly. Other materials with like or other beneficial properties could also be used. Regarding the central channel "cable," a metal or other sufficiently high tensile strength cable, wire, cord, or other like item, is run through the central channel of the Spine (hereinafter referred to as the "Spinal Cord"). On the top end of the Spinal Cord is a swage, cam lock or other suitable terminator or connection device (hereinafter this terminator or connection device will be referred to as the "Spine/1775 Frame Sheet Connector" or "Upper Swage") that, preferably, movably attaches the Spine to a, preferably, removable plastic, metal or other like material, plate bracket attached to the bottom of the 1775 Frame Sheet (hereinafter referred to as the Plate Bracket). Preferably, but without limitation, the Spinal Cord and "swage" (or other terminator) are comprised of metal in order to provide the strength needed to maintain the connection. On the bottom end of the Spinal Cord is a cam lock, swage or other suitable terminator or connection device that, preferably, movably attaches the Spine to the Belt Bracket (hereinafter this connection device will be referred to as the "Spine/Belt Bracket Connector" or "Lower Swage") and, therefore, to the CORPS Belt (since the Belt Bracket is attached to the CORPS Belt). It should be noted that the components making up the invention may be comprised of plastic, or other suitable materials, with the caveat that the materials selected preferably provide the strength necessary at the lowest possible weight. And it also should be noted that the connection means for connecting the Spine to the 1775 Frame Sheet and/or Corps Belt can be accomplished through a variety of means. As a non-limiting example, the connection of the Spinal Cord to the 1775 Frame Sheet could be realized without making use of a Plate Bracket through the use of a channel manufactured into the 1775 Frame Sheet that would allow the insertion into and capture of the Spinal Cord and "swage" (or other terminator) in the channel. Still further, while a preferable embodiment comprising three apertures and the consequent three channels (when more than one vertebra is "stacked") and the use of a cable or tube in each channel is described above, it should be noted that other embodiments featuring just one central aperture and consequent channel, or just two apertures (and their consequent channels) equidistant from a "vertebra" centerline (along with the use of cable(s), tubes or other flexible interconnection components) could be used in other embodiments as well.

Now back to the MSV PC. While the previously mentioned Fighting Vest (or Jacket) is or can be a base component of the MSV system, the MSV PC is the base vest for the MSV system. Furthermore, while the MSV encompasses multiple components and configurations, the MSV PC is the only component of the entire MSV suite that can accept/house the CORPS-LDS, or, in other words, the MSV can be worn in multiple configurations, but the CORPS-LDS can only be utilized when worn with the MSV PC component of the MSV. Still further, the MSV PC is worn by a user to provide fragmentation protection and to carry ballistic protection in the form of SAPI Plates. Furthermore, in order to provide load distribution, the MSV PC is capable of accepting and housing the CORPS-LDS. To provide scalable levels of armor protection, the MSV PC can be worn over the Fighting Vest (or Jacket) and/or with the Leatherneck Guard and/or the Tier-2 POG. The MSV PC can also utilize a quick release system that provides for the rapid release of the MSV PC and the CORPS-LDS from the user. Specifically, the MSV PC comprises: (1) a front ballistic panel; (2) a back ballistic panel; (3) a cummerbund assembly; and (4) a vest-release quick release system. More specifically, the front ballistic panel provides an interior pocket to house a SAPI plate and, without limitation, also provides an outer surface to which other equipment can be attached. The back ballistic panel provides an interior pocket to house a SAPI plate and/or accept the CORPS-LDS. Moreover, this back ballistic panel pocket can provide a means for the CORPS-LDS, or preferably the 1775 Frame Sheet portion of the CORPS-LDS, to be inserted and secured into the MSV PC (and the Vest). Currently, Velcro® straps are used to keep the 1775 Frame Sheet from slipping out of the MSV PC. However, other methods could be used. As a non-limiting example, arm-like structures that extend on either side of an attached Plate Bracket (which, without limitation, can preferably be used to nest a SAPI plate on the exterior surface of the 1775 Frame Sheet) could be used to "catch" on the well-known plate pocket flap that almost all armor vests have. (NOTE: The exterior surface of the 1775 Frame Sheet is the surface further away from the user when the 1775 Frame Sheet is being used or worn.) Therefore, while the operational use of the CORPS-LDS provides a means to distribute the load from the user's shoulders to their hips and/or pelvic area, it should be understood that the MSV's and/or MSV PC's flexible configurability allows the MSV and/or MSV PC to be used with or without the CORPS-LDS. Moreover, other components can be attached to the vest to provide even more protection and/or padding, and/or can be used to provide the user with additional features, as non-limiting examples these can include "side plate pockets," and "shoulder pads."

Preferably, the cummerbund assembly is comprised of two fabric bands constructed of a durable material, with or without ballistic materials, and is used to attach the back ballistic panel to the front ballistic panel in order to provide and maintain a secure fit to the user. Preferably, the cummerbund assembly can also be used to carry additional SAPI plates to provide additional protection to the sides of the user's abdomen. While some embodiments are described above and herein, it should be understood that a wide variety of different configurations using a wide variety of materials, and manufacturing processes can be used to make the cummerbund assembly and other elements of the invention as well.

Regarding the above-mentioned "release" systems, there are two distinct quick release systems associated with the MSV PC and the CORPS-LDS, one is well-known commercial vest-release quick release system that when actuated initiates a rapid release of the MSV PC from the user. The second is the CORPS-LDS release mechanism of this application that releases the CORPS-LDS's Spine component from the CORPS Belt component. In other words, it is preferable that: (1) The CORPS-LDS release mechanism will release with the actuation and the related operation of the vest-release quick release system allowing for the rapid release of both the MSV PC and the upper portions of the CORPS-LDS from the user; or (2) The CORPS-LDS release mechanism can be actuated to release the Spine from the CORPS Belt so that the CORPS Belt can be removed while still wearing the MSV PC or, alternatively, when the vest-release quick release system is actuated and operated the CORPS Belt can continue to be worn while allowing the user to remove the MSV PC and the upper portion of the CORPS-LDS. Moreover, in a preferable configuration the CORPS-LDS release mechanism is comprised of the components that make up the previously-described Spine/Belt Bracket Connector.

It is an aspect of the invention that the CORPS-LDS can be used to distribute the weight being carried in a manner that reduces the strain on the user's spine and back, and, thereby, may also lessen the metabolic expenditure of the user.

It is an aspect of the CORPS-LDS to provide full range of motion in the torso and shoulder through the use of a flexible spinal column that mimics the human spine. This spine allows the user to complete forward bends, side-to-side bends, torso twists, and other movements, which would be otherwise hindered by a rigid vertical support system.

It is another advantage of the CORPS-LDS that it is worn internal to the body armor system, which aids in eliminating user discomfort in the form of chafing and excess bulk. Wearing a body support system against the user increases the chance of the user experiencing chafing, hot spots, and pinching causing the user discomfort during the use of a system. By integrating the CORPS-LDS into the body armor system, the device is easier to use, more comfortable to wear since it does not rest directly against the user, and less bulky as there is no need for additional padding.

Another aspect of the CORPS-LDS is that it is capable of being rapidly released, which is useful in situations in which it would benefit the user to be unhindered such as when a user falls into water or is being stuck in a cramped space. This capability is especially pertinent if the device is to be used in military applications. Being unable to quickly release the system, especially when worn with additional weight, could cause harm or even death to a user in an emergency situation (e.g. falling in water and drowning) in which case other systems might become more of a burden than an aide. The CORPS-LDS is capable of being dismantled into its component parts allowing for easy transport and storage of the system. This also allows the user to wear only certain components of the system as best suits the user's need (e.g., just wearing the hip belt).

Moreover, the CORPS Belt utilizes a contoured shape that has a cut-out over the user's buttocks that allows the CORPS Belt to ride low on the user's hips and pelvis. This shape/design provides the following capabilities: lessens interference of the user's buttocks with the CORPS Belt, allows for weight to be transferred more evenly to the user's hips, and provides a more comfortable fit to the user. The CORPS Belt is currently comprised of fabric and ballistic materials and utilizes internal stiffeners to provide structural integrity to the belt; however, others materials and/or shapes can be used as well.

Accordingly, there are numerous applications for the MSV and/or CORPS-LDS to include military, law enforcement, recreational, sport, and industrial functions. The typical application of the CORPS-LDS is to utilize the CORPS-LDS in conjunction with a Vest/MSV PC or other similar vest, military armor, or pack system in order to distribute the weight of the system and its attachments from the user's shoulders to their hips and/or pelvic area while providing the user with superior mobility. Additional uses could include the use of the CORPS-LDS in standard recreational hiking packs. It is the Applicants' belief that integration with a hiking pack would allow such recreational user a freedom of movement and range of motion at the hips and waist not before realized when using the traditional loadbearing frames seen in today's hiking packs. In addition without limitation, the CORPS-LDS could be used, with additional add-on components and/or minor modifications, for supply personnel in industrial warehouses to assist in the handling of heavy cargo and machinery.

Additional features and advantages of the invention will be set forth in the description which follows and in part will be apparent from the description, and other parts of the disclosure of the presently described embodiments including the drawings, or may be learned from the practice of the invention. Other features and advantages of the invention will be realized and attained by the device and system particularly described in the written description, the drawings, and other portions of this disclosure. It is to be understood that the foregoing and the following detailed descriptions are exemplary and explanatory and are intended to provide further explanation of the invention as claimed.

BRIEF DESCRIPTION OF THE SEVERAL VIEWS OF THE DRAWING

In order to better understand the invention and to see how the same may be carried out in practice, non-limiting preferred embodiments of the invention will now be described with reference to the accompanying drawings, in which:

FIGS. 12*a*, 12*b* and 12*c* show a front, user's right side, and rear view, respectively, of a MSV PC in accordance with an embodiment of the present invention.

DETAILED DESCRIPTION OF THE INVENTION

Figure 1:
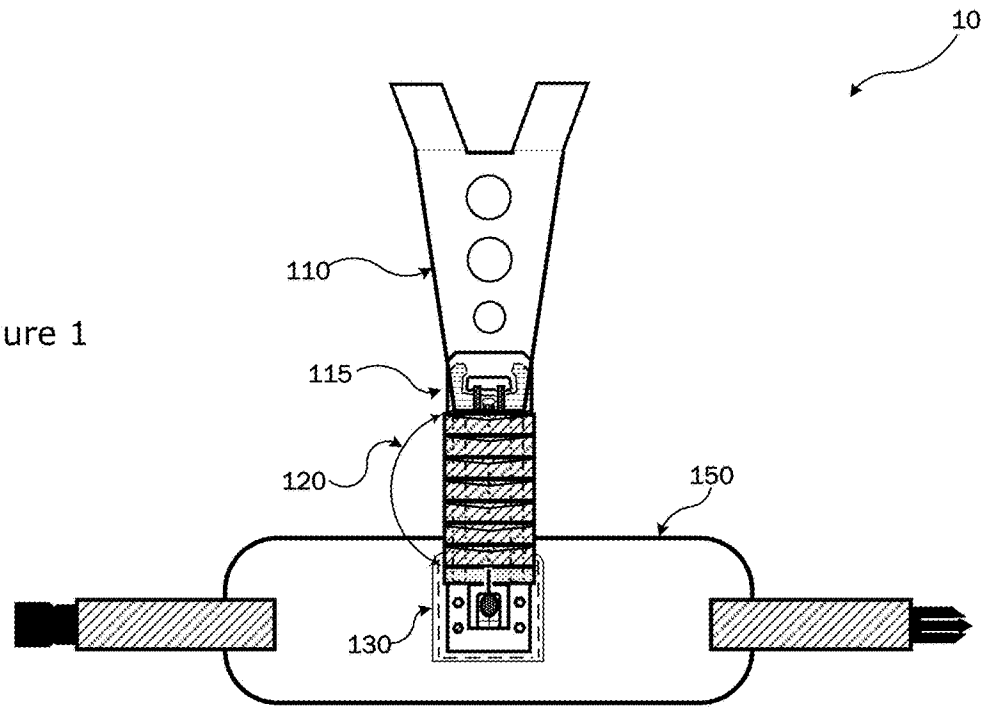
FIG. 1 is a rear view of one embodiment of the CORPS-LDS in accordance with an embodiment of the present invention.

Certain embodiments of the present invention will now be described more fully hereinafter with reference to the accompanying drawings, in which some, but not all embodiments of the invention are shown. Indeed, embodiments of the invention may be in many different forms and thus the invention should not be construed as limited to the embodiments set forth herein; rather these embodiments are provided as illustrative examples only. Furthermore, like numbers refer to like elements throughout, and the use of the abbreviation FIG. will be used to identify Figures. Furthermore, different embodiments of like items described below will be shown on different Figures with the same item number followed by one of more diacritical or accent marks (e.g., ', ", ‴, etc.). Moreover, the foregoing "Summary of the Invention" is incorporated into this "Detailed Description of the Invention" by reference as if set forth verbatim in this section of the application.

It will be readily understood that the components of the embodiments as generally described and illustrated in the drawings herein, could be arranged and designed in a wide variety of different configurations using a wide variety of materials, and manufactured using a variety of processes. Thus, the description of the certain described embodiments of the system, components and/or methods of the present invention, as represented by the drawings, is not intended to limit the scope of the invention, as claimed, but is merely representative of embodiments of the invention.

Referring now to the drawings, and more particularly to FIG. 1, there is shown a non-limiting example of the CORPS-LDS 10, which may be construed as an embodiment of the present invention device. In general, the CORPS-LDS 10 is comprised of the 1775 Frame Sheet 110 and attached Plate Bracket 115; the Spine 120; the Belt Bracket 130; and the CORPS Belt 150. As to the Plate Bracket 115 shown in FIG. 1, while it is preferable to attach a Plate Bracket 115 to the 1775 Frame Sheet 110, another embodiment of the invention may not incorporate use of a Plate Bracket 115, and, in which case, attachment of the Spine 120 to the 1775 Frame Sheet 110 would be implemented through alternative means or methods.

Figure 2B:
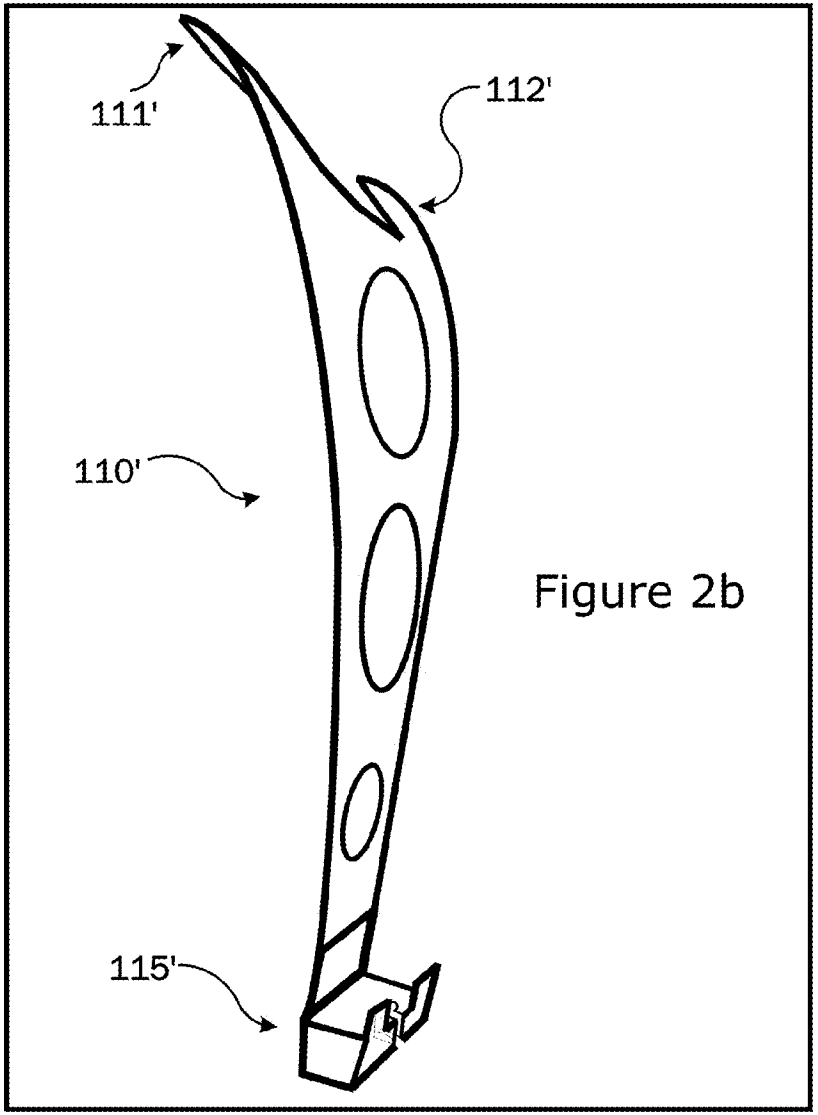
FIG. 2*b* is a side perspective view of the 1775 Frame Sheet and Plate Bracket constructed in accordance with an embodiment of the present invention.
Figure 2A:
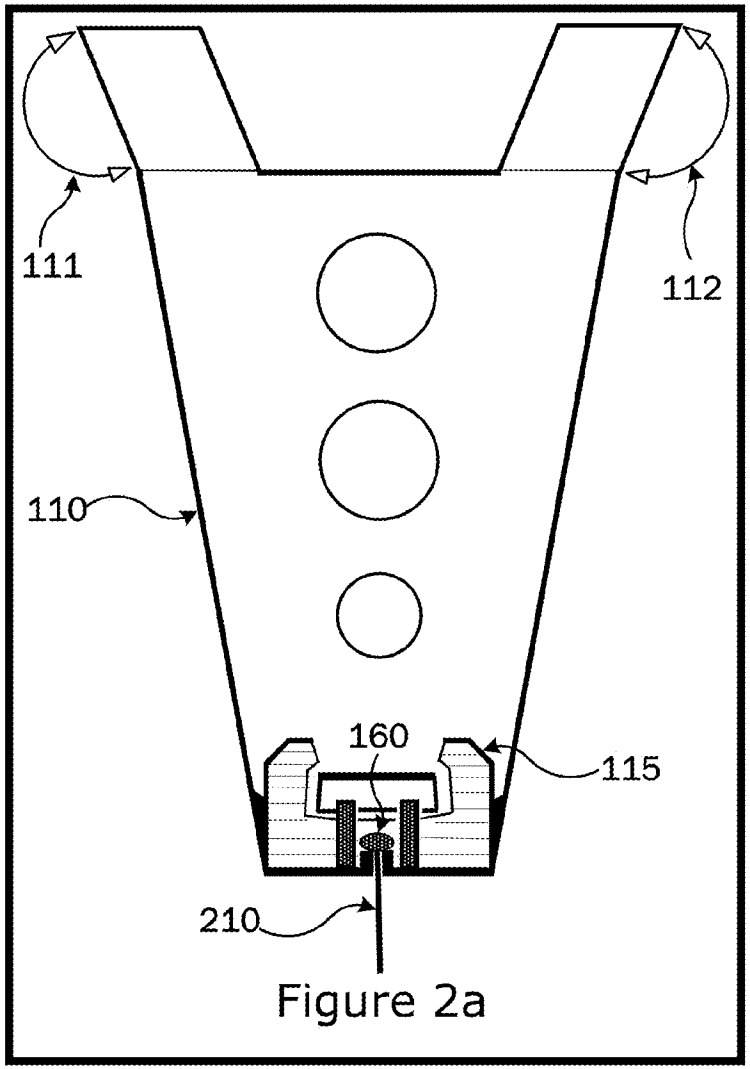
FIG. 2*a* is a rear view of the 1775 Frame Sheet and Plate Bracket constructed in accordance with an embodiment of the present invention.

Referring now to FIGS. 2*a* (& 2*b*), an embodiment (and a second embodiment shown in 2*b*) of the 1775 Frame Sheet 110 (& 110') and the Plate Bracket 115 (& 115') are shown. As shown in FIG. 2*b*, but without limitation, this embodiment of the current design of the 1775 Frame Sheet 110' is preferably contoured to match the complex curvature of Small Arms Protective Insert (SAPI)/Plate (not shown) utilized by law enforcement and military personnel to provide protection against various types of projectiles.

Also, without limitation, the 1775 Frame Sheet 110 (& 110') is preferably designed to have vertical extensions (or wing sections) 111 & 112 as shown in FIG. 2*a* (or 111' & 112' as shown in FIG. 2*b*) that extend beyond the vertical dimensions of a SAPI/Plate (not shown), and when a SAPI/Plate is nested in the Plate Bracket 115 as shown in FIG. 2*a* (or 115' as shown in FIG. 2*b*) the SAPI/Plate would ride on the back of the 1775 Frame Sheet 110 (& 110') in an area on or near the user's back, shoulder and/or upper torso. These vertical extensions 111 & 112 (or 111' & 112') act as a structural means of transferring the weight of a tactical vest such as, but without limitation, the U.S. Marine Corps' Modular Scalable Vest (MSV or Vest) including the MSV Plate Carrier (MSV PC) component of the MSV, and a significant portion of the load carried by such a MSV to the 1775 Frame Sheet 110 (& 110') and other elements of the invention to a user's hips and/or pelvic area. According to Applicants, the 1775 Frame Sheet 110 (& 110') provides the structure and support for the CORPS-LDS 10, at least on the user's upper torso area, and initiates the transfer of the load to the articulating external spinal column, i.e., the Spine 120 (shown in FIG. 1). In other words, the Frame Sheet 110 (& 110') serves as an interface between the user and the load borne by the user when transferring the weight from the user's shoulders to a user's hips and/or pelvic area. Moreover, in one preferred embodiment of the invention, the percentage weight transfer is adjustable, and, as a non-limiting example, 20% (more or less) of the weight could be on or carried by the user's shoulders and the remaining 80% (less or more) of the weight could be essentially transferred or carried by a user's hips and/or pelvic region. Moreover, the MSV and the MSV PC are designed so that the MSV and/or MSV PC may be used with or without the CORPS-LDS (i.e., the CORPS-LDS is designed to be a removable feature vice being fixed and required).

However, it also should be noted that the shape of the 1775 Frame Sheet 110 (& 110') is not limited to the contour and profile of the SAPI plate and can take on varying ergonomic forms to match the contour of a user's upper torso profile and/or the profile of the load that will be carried by the CORPS-LDS 10 and the 1775 Frame Sheet 110 (& 110').

The 1775 Frame Sheet 110 (& 110' and the other 1775 Frame Sheet embodiments shown on several of the other Figures) is currently constructed using a maple wood core with a carbon fiber laminate. The current construction process is similar to that used for typical ski and snowboard designs/products, and it is currently believed to provide the present invention with sufficient durability at the lightest weight. Preferably, without limitation, other material options for the 1775 Frame Sheet 110 (& 110' (and the other embodiments of the 1775 Frame Sheet)) can include the use of plastic, metal or composites, and could utilize other suitable construction/manufacturing processes as needed for the application/use.

Figure 9B:
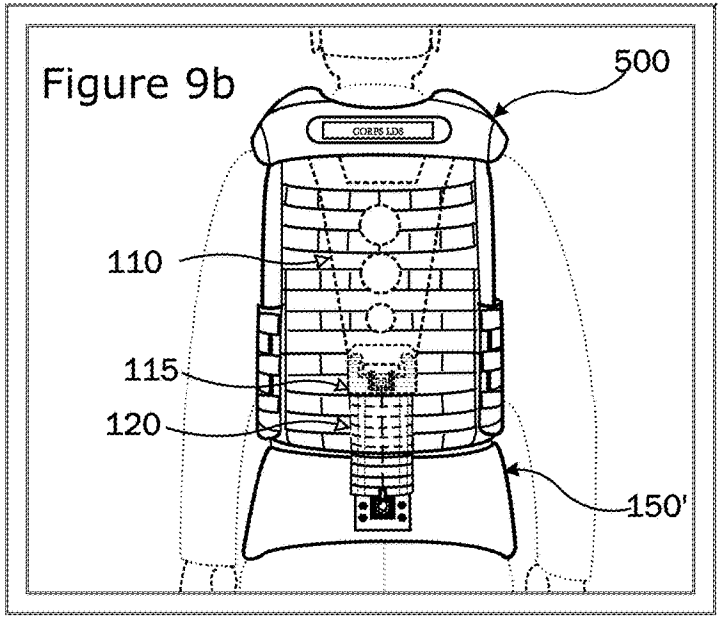
FIG. 9*b* is a rear view of the MSV PC showing the upper portion of the CORPS-LDS located inside the back of a MSV PC in accordance with an embodiment of the present invention.
Figure 9D:
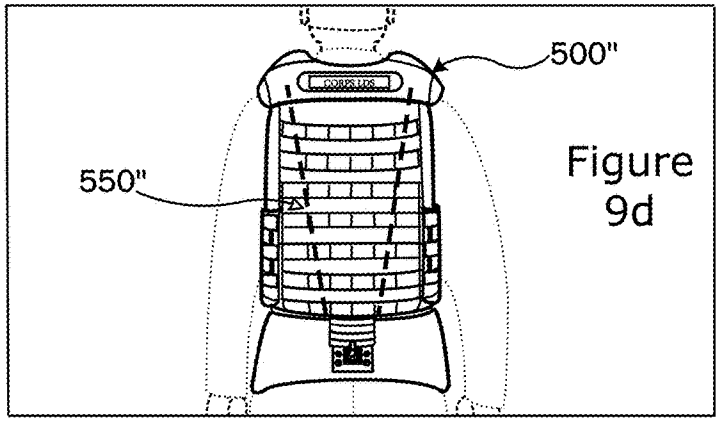
FIG. 9*d* is a rear view of the MSV PC showing an "angled" pocket located inside the back of a MSV PC in accordance with an embodiment of the present invention.
Figure 9A:
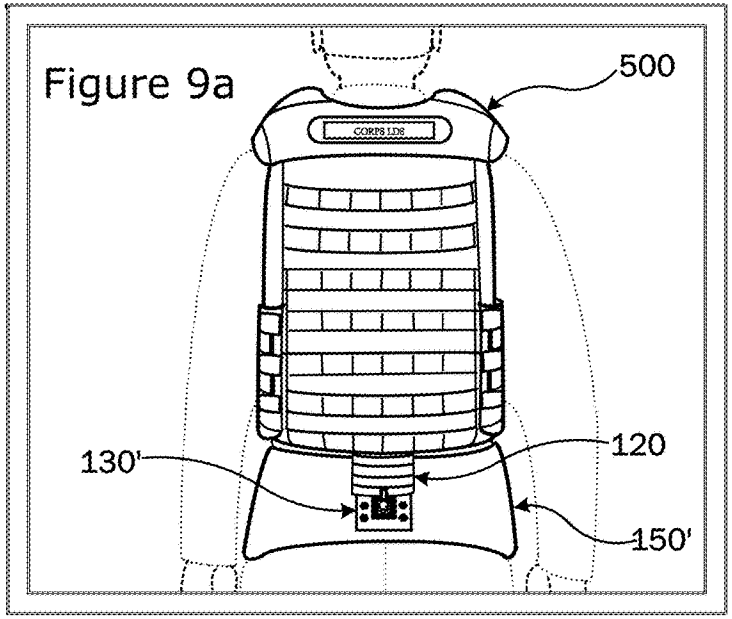
FIG. 9*a* is a rear view showing the back of an embodiment of the MSV comprising the MSV PC and Belt, and showing the bottom of a Spine shown attached to the Belt Bracket in accordance with an embodiment of the present invention.
Figure 9C:
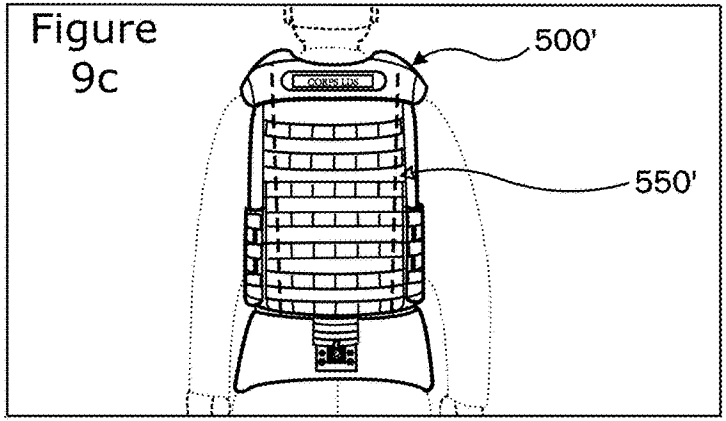
FIG. 9*c* is a rear view of the MSV PC showing a "rectangular" pocket located inside the back of a MSV PC in accordance with an embodiment of the present invention.

Now while referring to FIGS. 2*a*, 2*b*, 9*c* and 9*d*, and while a SAPI plate is not shown in these FIGS., the current design of the 1775 Frame Sheet 110 (or 110') allows for a SAPI plate to "nest" in a Plate Bracket 115 (or 115'), which, in turn, allows a SAPI plate to ride on or is adjoining to the outer surface of the 1775 Frame Sheet 110 (or 110') (i.e., when being worn the 1775 Frame Sheet outer surface is the surface furthest away from a user). Preferably when used with a MSV PC (and/or MSV), the 1775 Frame Sheet 110 (& 110') resides inside the back SAPI plate pocket (as shown in FIG. 9*c* as 550', and in FIG. 9*d* as 550") of the back of the MSV PC, which, as preferably shown, is designed or can be modified to accommodate the 1775 Frame Sheet 110 (& 110'). Preferably, as shown in FIG. 9*b*, 9*c* and/or 9*d*, the upper portion of CORPS-LDS 10 is inserted into a "pocket" 550' (or 550") that is sewn or otherwise attached to the interior side of the back of the MSV PC 500', it should be realized, however, that attachment of the CORP-LDS 10 with a MSV PC 500' is not limited to such a pocket and could be accomplished through other means. Moreover, the Plate Bracket 115 (or 115') at the bottom of the 1775 Frame Sheet 110 (or 110') is preferably rigidly attached to the 1775 Frame Sheet, and provides the connection point to which the Spine 120 attaches to the 1775 Frame Sheet. As previously described, an alternative, non-limiting, Plate Bracket design could incorporate the use of a modification to secure the 1775 Frame Sheet 110 (or 110') inside the well-known plate pocket flap that almost all armor vests (including the MSV PC) have. For example, the use of arm-like structures (not shown) extending on either side of a Plate Bracket could be used to "catch" on the well-known plate pocket flap. Currently, the Plate Bracket 115 (or 115') is riveted onto the 1775 Frame Sheet 110 (or 110'); however, other attachment means such as an adhesive, screws, or even making it an integral part of the 1775 Frame Sheet 110 (or 110') itself could be used. In another non-limiting embodiment, the Plate Bracket 115 (or 115') is not required and/or used, and the CORPS-LDS including its Spine connection can still be worn by a user. In other words, in this alternate embodiment, the Spine is attached to the 1775 Frame Sheet using a different (non-plate) bracket or other similar means that would still provide the articulation function of the Spine, and, thereby, still allow for the inventive load distribution function to be provided by the CORPS-LDS when the CORPS-LDS is worn without the use of a Plate Bracket or ballistic protection plate.

Figure 3:
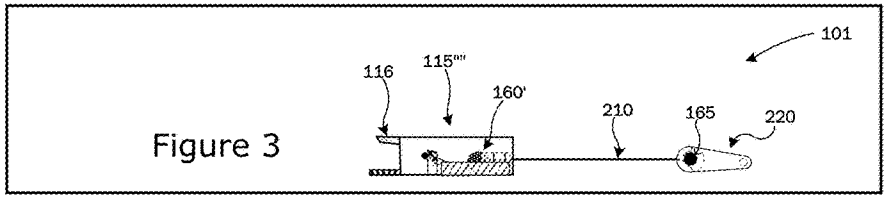
FIG. 3 is a side view of a Plate Bracket, Spinal Cord, and both the Spine/Belt Bracket Connector and the Spine/1775 Frame Sheet Connector in accordance with an embodiment of the invention.

Referring now to FIG. 3 and FIG. 1, FIG. 3 shows a non-limiting embodiment of Plate Bracket 115"" and the connection system 101 used to connect the Spine 120 (shown in FIG. 1) between the 1775 Frame Sheet 110 and the Belt Bracket 130 (both of which are shown in FIG. 1). As previously described, and preferably, on the top end of the Spinal Cord 210 is an upper swage 160' (hereinafter referred to as the "Spine/1775 Frame Sheet Connector" or "Upper Swage") that, preferably, movably, attaches the Spine 120 to the Plate Bracket 115, which is attached to the bottom of the 1775 Frame Sheet 110. Preferably, on the bottom end of the Spinal Cord 210 is a lower swage 165 (hereinafter referred to as the "Lower Swage"). Preferably, the Lower Swage 165 movably, attaches the Spine 120 to the Belt Bracket 130, and, therefore, the CORPS Belt 150 (since the Belt Bracket 130 is attached to the CORPS Belt 150) through the nesting of the Lower Swage 165 into, and use of, the locking device 220, (note that the locking device 220 may hereinafter be referred to as the CORPS-LDS "quick-release" mechanism). As shown in FIG. 3, the "quick-release" mechanism 220 is preferably, but without limitation, comprised of a cam-type locking device. Preferably, besides using the well-known operational features of "cam-type" locking devices, the locking device 220 and the Lower Swage 165 portion of the connection system 101 both allow or provide for the attachment of the Spine 120 to the Belt Bracket 115 and also provides a "quick-release" capability, i.e., rotating the locking device 220 away from the Belt Bracket 130 or, in other words "opening" the locking device 220 will allow the separation of the CORPS Belt 150 and Belt Bracket 130 from the Spine 120 and 1775 Frame Sheet 110. Moreover, the Spine 120 and 1775 Frame Sheet 110 can also be quickly released from the CORPS Belt and Belt Bracket by utilizing the well-known Vest (or MSV PC) quick-release feature, in which case, as the quick-release feature is actuated the MSV PC would fall away from the user, and consequently, the Lower Swage 165 will slide out of, and, therefore, disengage from the Belt Bracket 130. Or, as previously described, the CORPS-LDS quick-release feature can be operated manually by opening, i.e., rotating the locking device into a release position; thereby, disengaging, the locking device 220 from the Belt Bracket 130. It should be understood, that while use of a cam type locking device is preferable other suitable devices or components can be used as well. Moreover, it should be noted that these release systems are designed to operate without interference even while the user is in a vertical orientation.

Preferably, but without limitation, the Spinal Cord is constructed of a metal cable; the Spine/1775 Frame Sheet Connector (Upper Swage) and the Lower Swage are both currently manufactured from metal, and the locking device is currently manufactured from a ruggedized composite plastic through which one end of the Spinal Cord is fed and attaches to the locking device through the use of the Lower Swage (or through the use of a screw or other suitable cable terminator). While the use of a swage type device is described above, it should be noted that, without limitation, other cable end terminators and suitable connection devices can be used. Moreover, while plastic or metallic components are preferable, it should be realized that other suitable alternative materials of sufficient load bearing and operational capabilities can be substituted for any or all of the items of the connection system 101.

According to the invention, the design of the Spine 120 (and its other embodiments) allows the user to bend and twist at the waist, i.e., in order to make or complete various movements. When in the upright standing, walking or running position, a portion of the weight of the CORPS-LDS 10 (as shown in FIG. 1) and any ancillary equipment borne by the user is distributed from the Frame Sheet 110 through Spine 120 to the CORPS Belt 150 (as shown in FIG. 1).

Figure 4B:
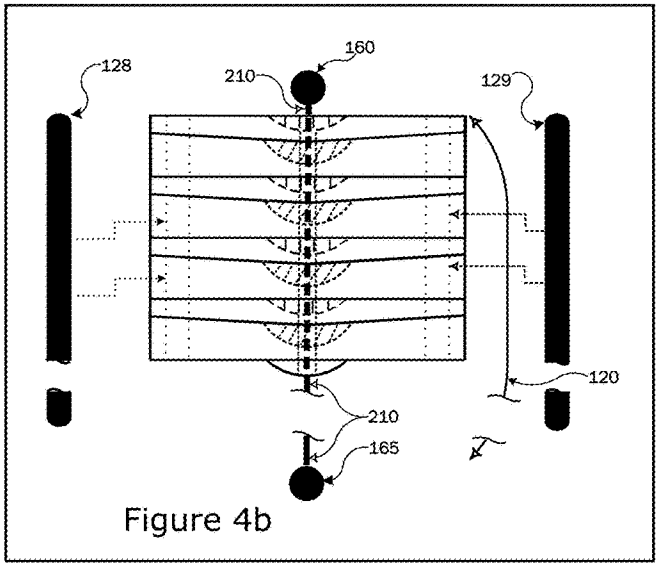
FIG. 4*b* is a view of an articulating loadbearing Spine showing a Spine (i.e., a vertebra stack), the Spinal Cord, the over rotation/articulation tubes and both the Spine/Belt Bracket Connector and the Spine/1775 Frame Sheet connector in accordance with an embodiment of the invention.
Figure 4A:
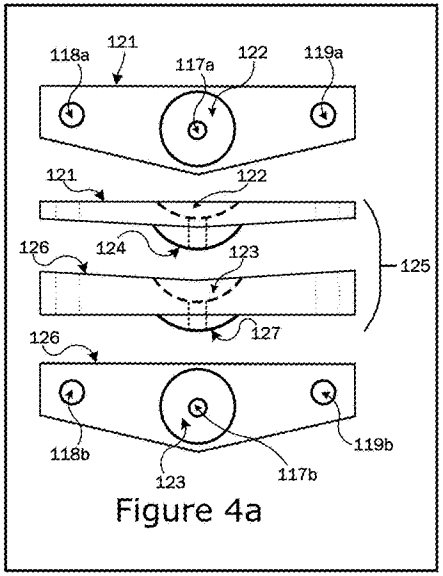
FIG. 4*a* are top and side views of upper and lower vertebra sections in accordance with an embodiment of the invention.

Now additionally referring to FIGS. 4*a* and 4*b*, the Spine's 120 vertical dimension (or height) is, without limitation, adjustable by varying the number of "vertebra" 125 used, or by using "vertebra" of differing vertical dimensions, i.e., differing heights. The "vertebra" 125 is preferably comprised of rigid 121 and semi-rigid 126 vertebra components or elements. Moreover, the vertical orientation of the Spine 120 with respect to a user's back can also be raised or lowered through the use of separate adjustment means associated with the Plate Bracket 115 and/or the Belt Bracket 130, e.g., this adjustment can be accomplished through the use of vertically adjustable connectors between the Spine 120 and 1775 Frame Sheet 110 and/or the Spine 120 and CORPS Belt/Belt Bracket 130 connection.

More specifically, the preferable configuration of the Spine 120 is comprised of at least one vertebra 125, which itself is comprised of at least one pair of components, i.e., an upper vertebra component 121 and a lower vertebra component 126. Each vertebra component 121 and 126, respectively, has a ball and socket-like joint configuration comprised of an upper vertebra component "ball" 124, a lower vertebra component "ball" 127, an upper vertebra component "socket" 122, and a lower vertebra component "socket" 123. It is readily apparent that the "ball" 124 of the upper vertebra component 121 would "fit" or "nest" in the "socket" 123 of the lower vertebra component 126, and that the "ball" 127 of a lower vertebra component 126 would "fit" or "nest" in the "socket" 122 of a upper vertebra component 121. Consequently, each "vertebra" 125 is comprised of, and benefits from the features of, this combination of an upper vertebra component 121 and a lower vertebra component 126.

To provide the capability of movable connecting a stack of "vertebra" together, primarily, but without limitation, for the purpose of forming the Spine 120, each upper vertebra component 121 and each lower vertebra component 126 is designed and manufactured with a hole or aperture running through the center 117*a* of the upper vertebra component 121, and a hole or aperture running through the center 117*b* of the lower vertebra component 126; a hole or aperture running through the left side 118*a* and the right side 119*a* of the upper vertebra component 121; and a hole or aperture running through the left side 118*b* and the right side 119*b* of the lower vertebra component 126, respectively. Thereby, the aligning of these holes or apertures forms three (i.e., center, left, and right) open channels through each of a stack of vertebra 125, or in other words, through the Spine 120. The Spinal Cord 210 runs through the center channel of the Spine. Furthermore, preferably running through or inserted into the left and right side channels of the Spine 120 are rubber or rubber-like "tubes" 128 & 129, which are used to assist in ensuring the upper vertebra component 121, the lower vertebra component 126, the vertebra 125 itself and the vertebra stack, i.e., the Spine 120, remain substantially engaged, and to prevent the over-rotation and/or over-bending of the Spine 120. While it is preferable that the left tube 128 and the right tube 129 are inserted using a press-fit process, a less restrictive insertion method may be used as well. Moreover, while it is preferable that rubber or rubber-like materials are used for the tubes 128 & 129, it should be realized, but without limitation, that other flexible or semi-rigid materials including cables akin to the Spinal Cord may be used as well. Moreover, other embodiments of the Spine could comprise just the central channel, or just the left and right channels—which would require the use of a different connection system including, without limitation, a two-to-one interface, i.e., the two tubes or cables running through the left and right channels could be connected to the left and rights sides of a lower end of an interface bracket that utilizes a single, center cable that would be capable of connecting the interface bracket to the Plate Bracket.

Figure 5:
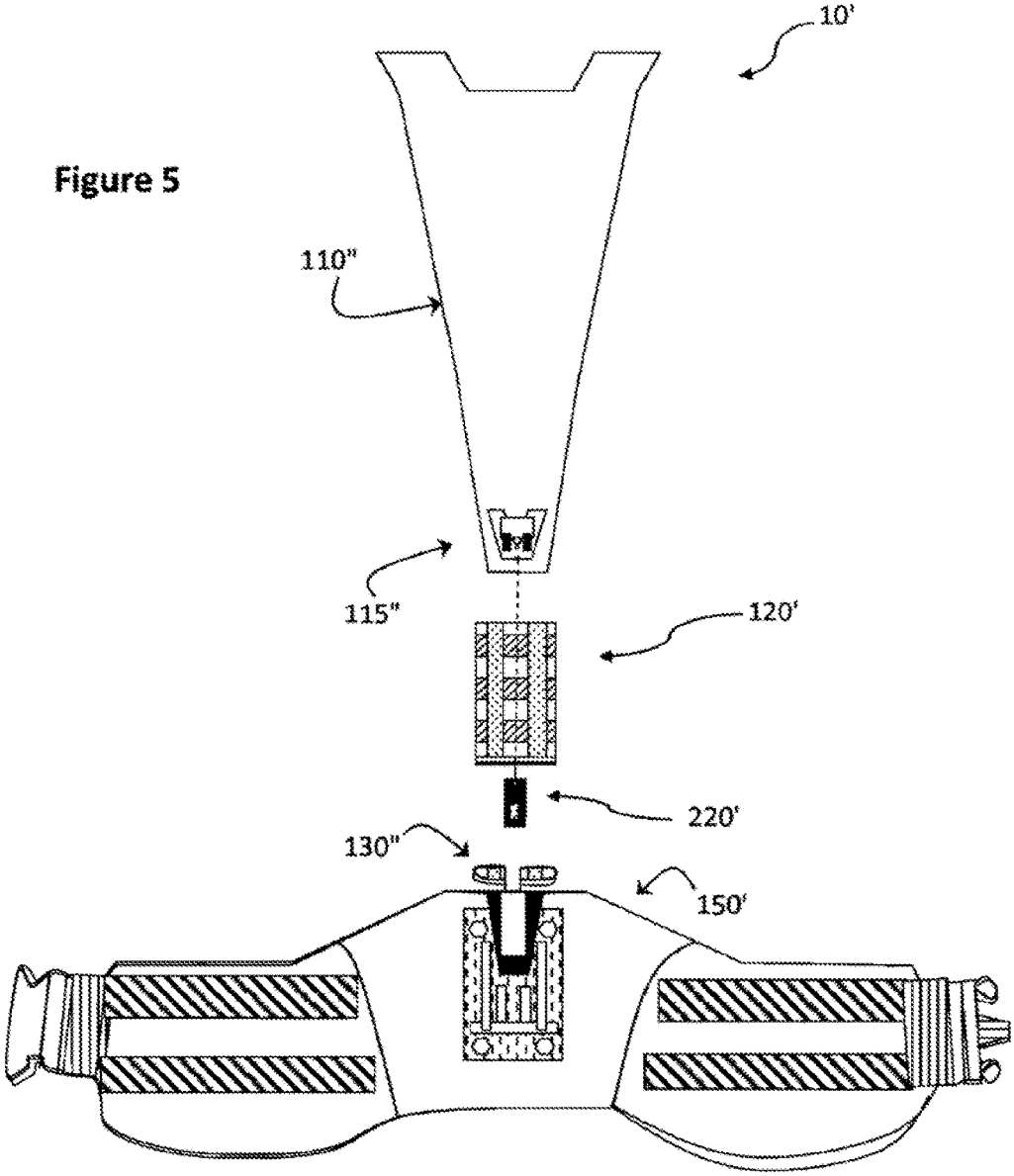
FIG. 5 is a rear view of the CORPS-LDS showing the CORPS-LDS partially disassembled in accordance with an embodiment of the present invention.
Figure 6A:
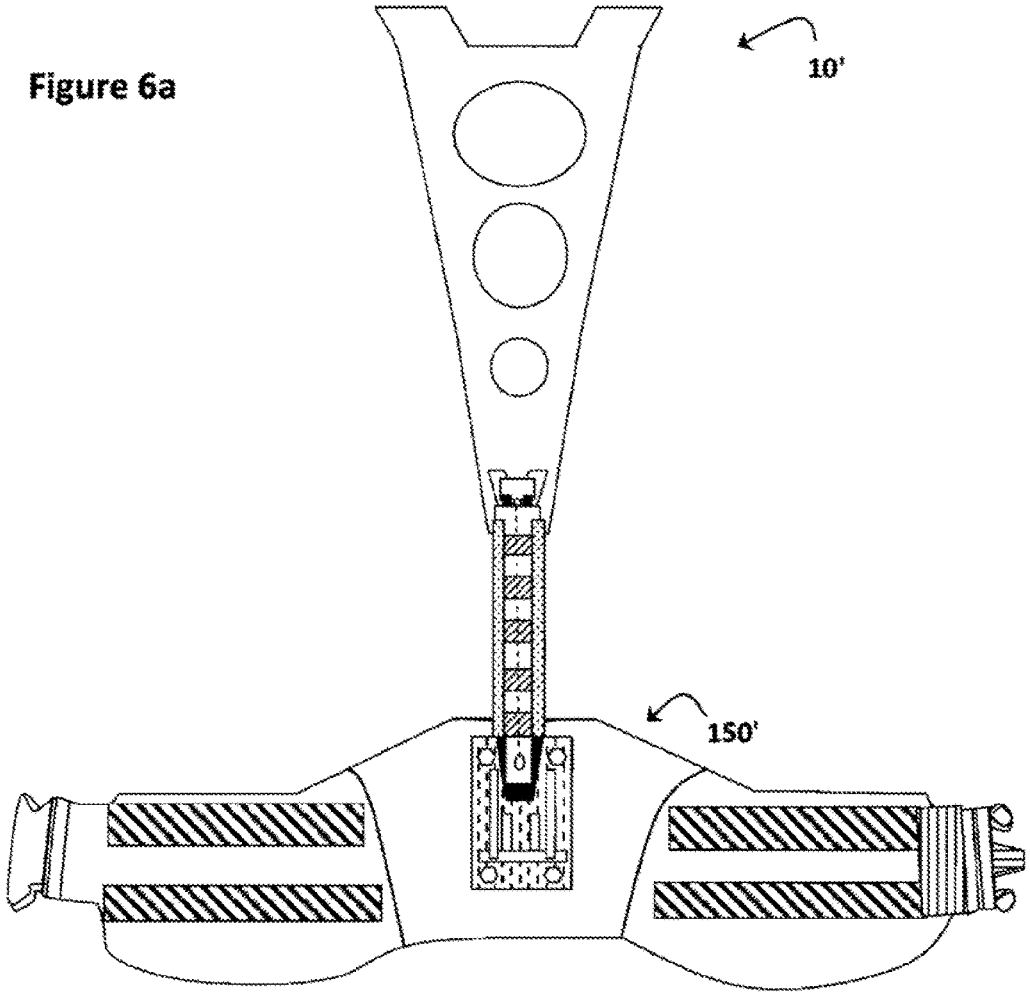
FIG. 6*a* is a rear view of the CORPS-LDS showing an assembled CORPS-LDS in accordance with an embodiment of the present invention.
Figure 6B:
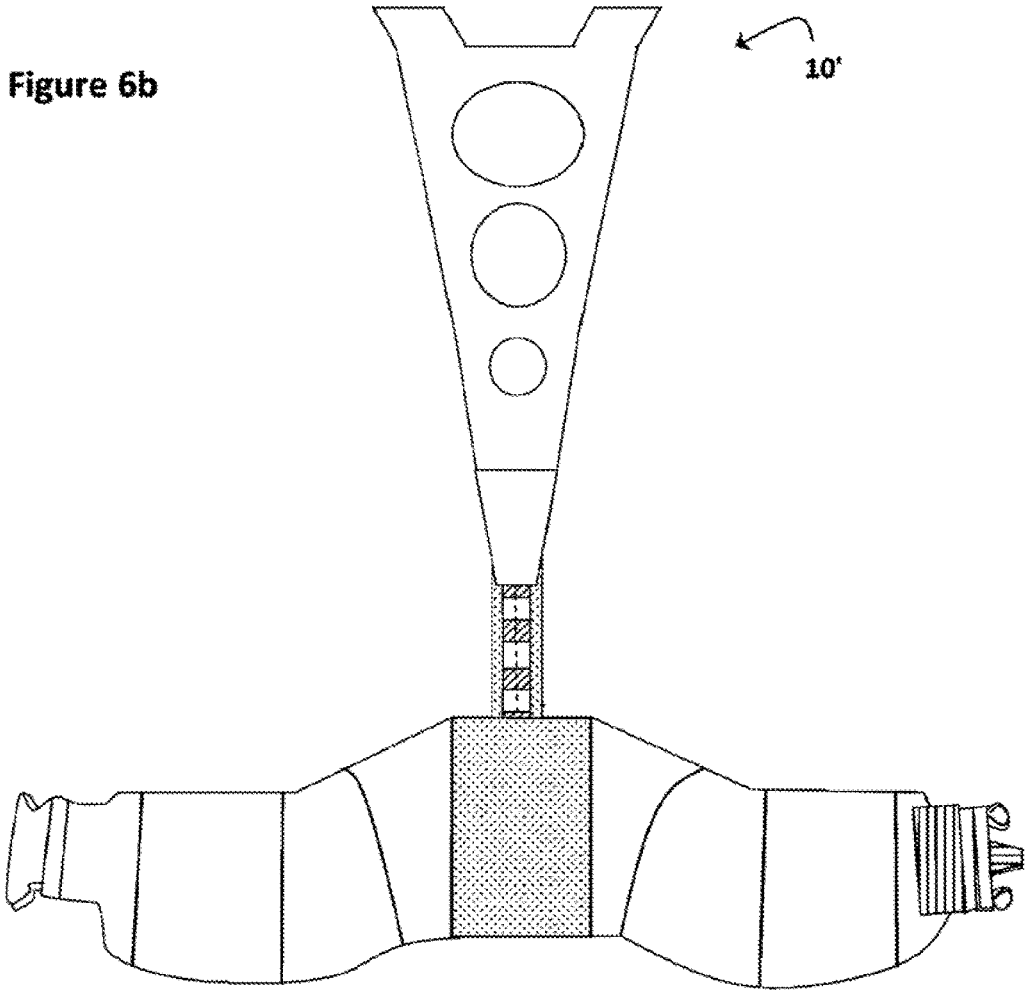
FIG. 6*b* is a front view of the CORPS-LDS showing an assembled CORPS-LDS in accordance with an embodiment of the present invention.

Referring now to FIG. 5, an "exploded" rear view of an embodiment of the CORPS-LDS 10' and its component parts (110", 115", 120', 130", 150', and 220') are shown. And, referring now to FIGS. 6*a* and 6*b*, the rear view and front view, respectively, of an assembled CORPS-LDS 10' are shown.

Figure 7:
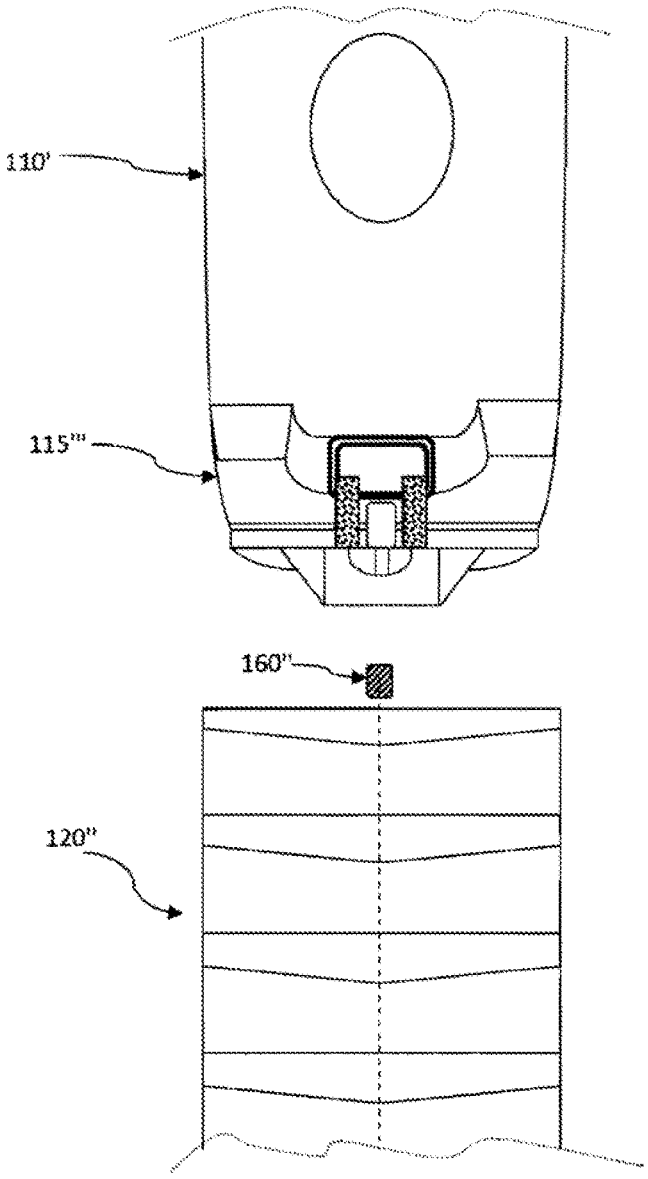
FIG. 7 is a rear perspective view of a top portion of a Spine showing a swage connected to the top of a Spinal Cord, and showing the Spine in close proximity to, but not connected to, the bottom of a 1775 Frame Sheet with attached Plate Bracket in accordance with one embodiment of the invention.

Referring now to FIG. 7, a view of components of an embodiment of the CORPS-LDS is shown. More specifically, FIG. 7 shows an embodiment of the top of a Spine 120" and Upper Swage (Spine/1775 Frame Sheet Connector) 160", and the bottom of the 1775 Frame Sheet 110' and the Plate Bracket 115'" while the Spine and Frame Sheet are separated from each other. In this embodiment, the Spine attachment mechanism (which is shown as centrally located on the Plate Bracket) when in the unlocked or open position will allow for the Upper Swage 160" to be inserted into the attachment mechanism portion of the Plate Bracket 115'", which can then be locked or closed in order to movably attach the Spine to the 1775 Frame Sheet, and while still providing or allowing the Spine to rotate and otherwise move relative to the 1775 Frame Sheet and Plate Bracket.

Figure 8A:
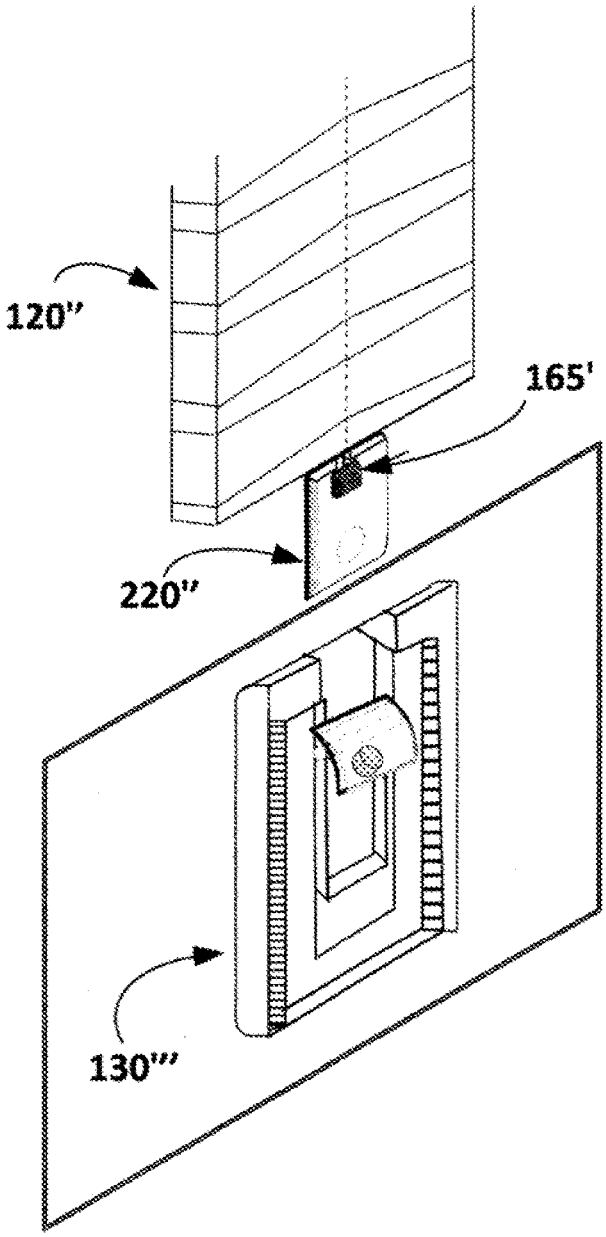
FIGS. 8*a*, 8*b* and 8*c* show rear perspective views of the operation of connecting the 1775 Frame Sheet and Spine to a Belt Bracket in accordance with an embodiment of the present invention.
Figure 8B:
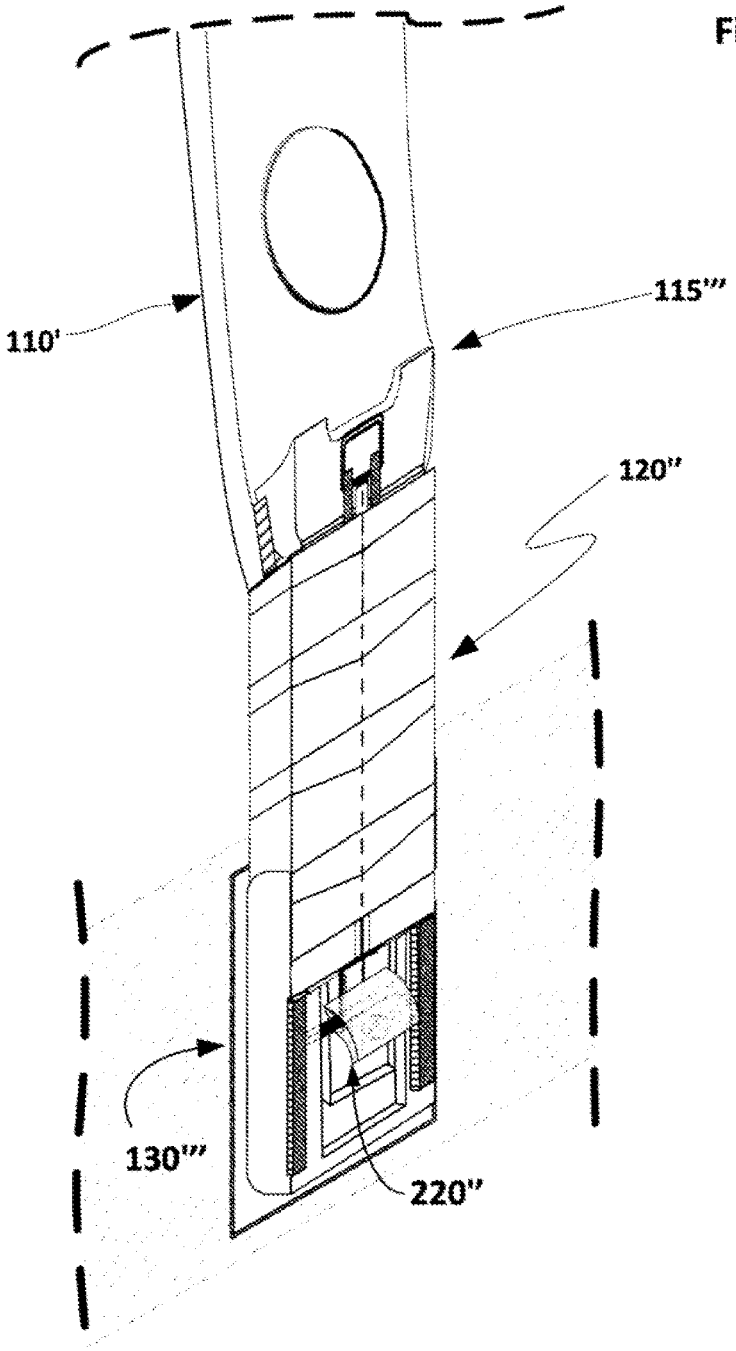
Figure 8C:
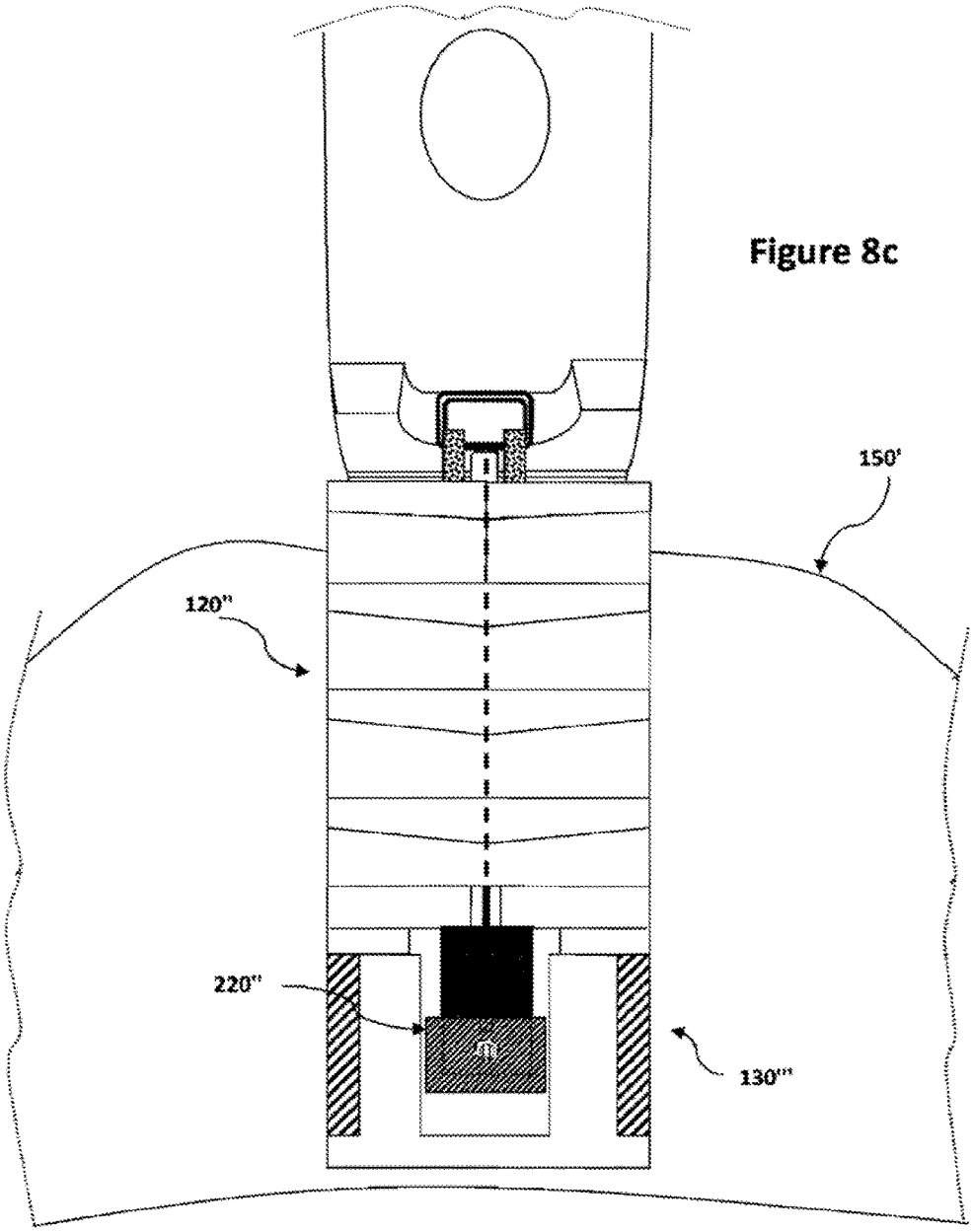
Figures 11A, 11B:
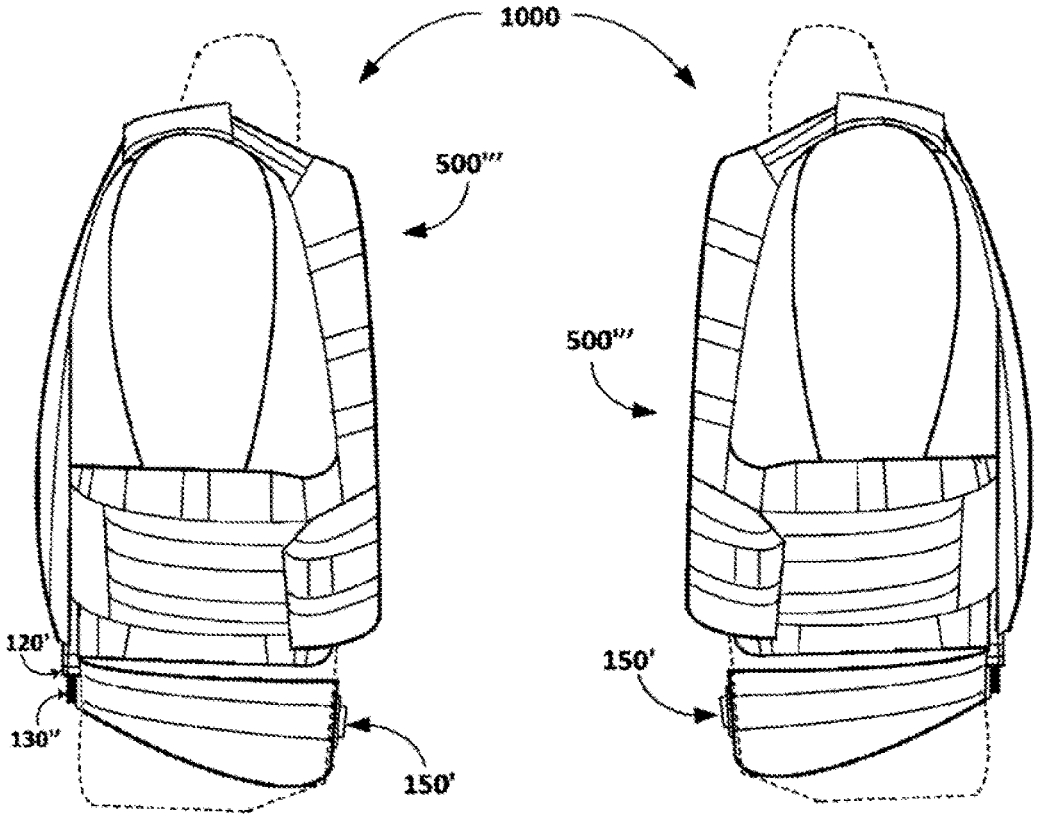
FIG. 11*a* shows a user's right-side view of the MSV (comprising the MSV PC with CORPS-LDS, and Belt) in accordance with an embodiment of the present invention.
FIG. 11*b* shows a user's left-side view of the MSV (comprising the MSV PC with CORPS-LDS, and Belt) in accordance with an embodiment of the present invention.

Referring now to FIGS. 8*a*, 8*b*, and 8*c*, these FIGS. show more detail regarding the attachment of an embodiment of the Spine 120" to an embodiment of the Belt Bracket 130". More specifically, the upper portion of FIG. 11*a* shows the bottom of the Spine, and also shows the ends of the tubes running through the Spine, and the locking device 220" (and also shows the locking device 220" connected to the Lower Swage 165'). Furthermore, the lower portion of FIG. 8*a* shows an embodiment of the Belt Bracket 130'", which also shows the integral locking mechanism for locking the locking device 220" to the Belt Bracket. Referring now to FIG. 8*b*, shown is the locking device 220" inserted into the locking mechanism in the open or unlocked position. To complete the attachment process, the locking device 220" is rotated into the closed or locked position as shown in FIG. 8*c*. It should be noted that embodiments of the Belt Bracket are designed so that the locking mechanism portion of the Belt Bracket can vertically move for up to several inches relative to the Belt Bracket; therefore, once the locking device 220" is locked the CORPS-LDS and the user are provided with an enhanced bending movement feature.

Figure 9E:
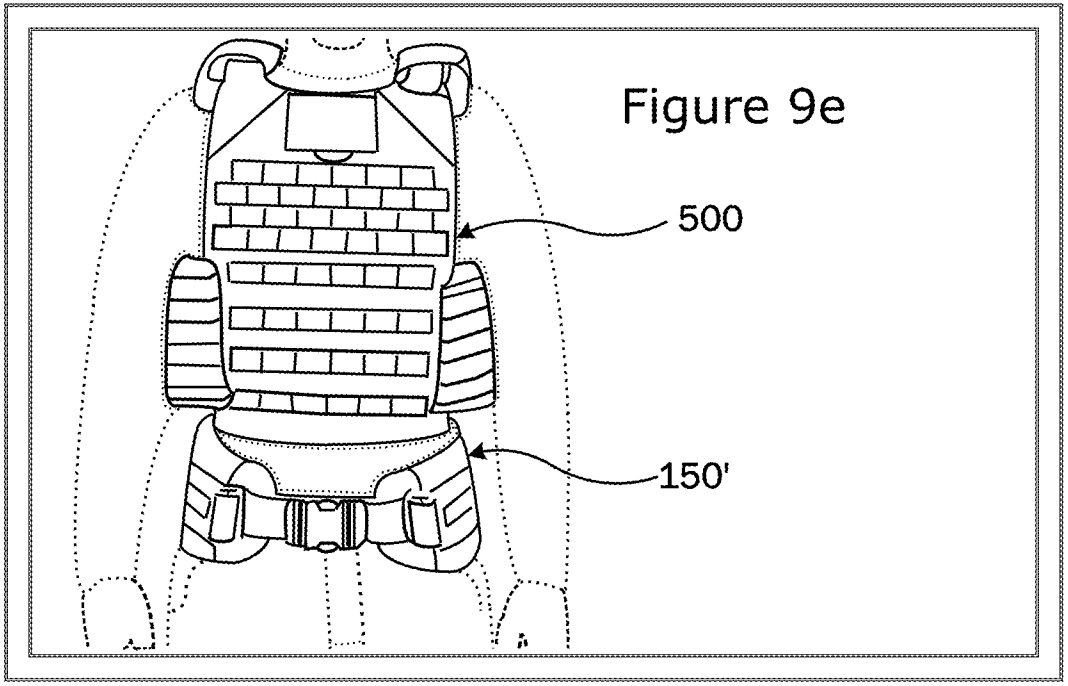
FIG. 9*e* is a front view of a MSV PC and Belt in accordance with an embodiment of the present invention.

Referring now to FIGS. 9*a* and 9*b*, each of these FIGS. shows a rear view of an embodiment of a MSV (MSV PC) 500. And FIG. 9*b*, additionally shows not only the visible portions of the CORPS-LDS when worn with the MSV-PC 500, but it also shows the hidden (or cut-away) view portion of the CORPS-LDS as well. More specifically, this cut-away view shows how the remainder of a complete CORPS-LDS 10, i.e., the upper portion of the Spine 120, the Plate Bracket 115, and the 1775 Frame Sheet 110, would be located within the MSV PC 500 when the MSV PC 500 and CORPS-LDS 10 is worn by a user. Furthermore, the front view of an embodiment of the MSV PC 500 and Corps Belt 150' is shown in FIG. 9*e*.

Figures 10A, 10B:
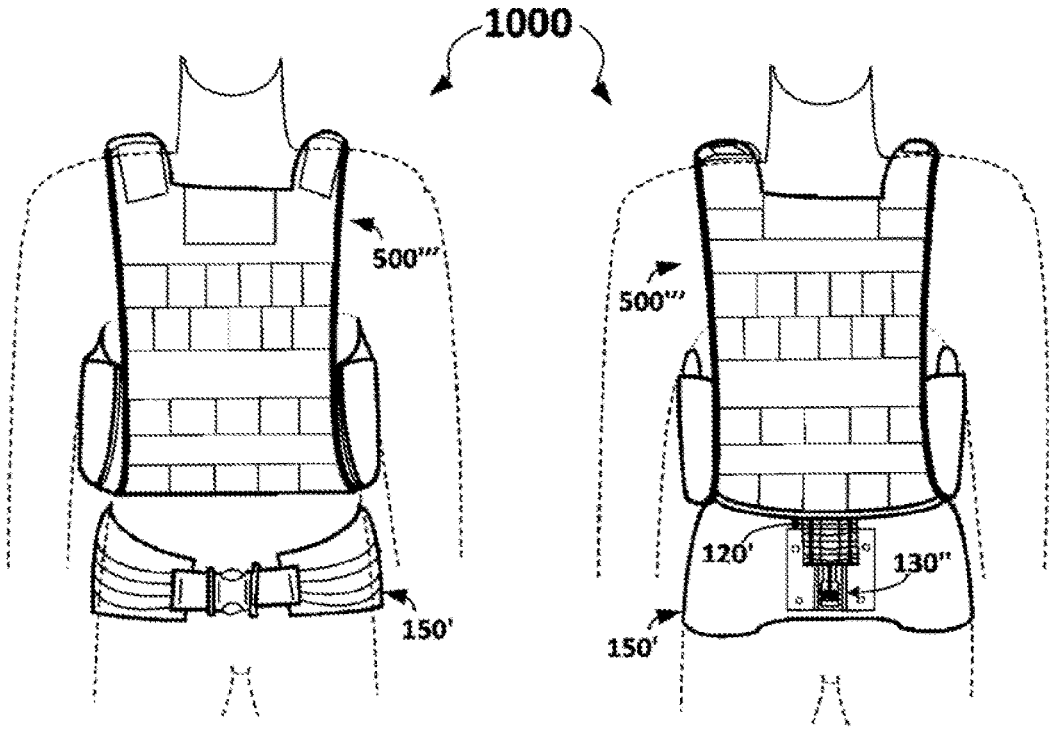
FIG. 10*a* shows a front view of the MSV (comprising the MSV PC and Belt) in accordance with an embodiment of the present invention.
FIG. 10*b* shows a rear view of the MSV (comprising the MSV PC with CORPS-LDS, and Belt) in accordance with an embodiment of the present invention.

Referring now to FIGS. 10*a* and 10*b*, these FIGS. show the front view and rear view, respectively, of an embodiment of the MSV 1000 including the MSV PC 500'", the Corps Belt 150' and the other components of the lower portion of the CORPS-LDS (shown in FIG. 10*b*).

Referring now to FIGS. 11*a* & 11*b*, a user's right side and user's left side views of an embodiment of the MSV-PC 500'", CORPS Belt 150' and other portions of the CORPS-LDS are respectively shown. Furthermore, a user's front side, right side, and rear side views of an embodiment of the MSV-PC 500'" are respectively shown in FIGS. 12, 12*b*, and 12*c*.

Figure 13:
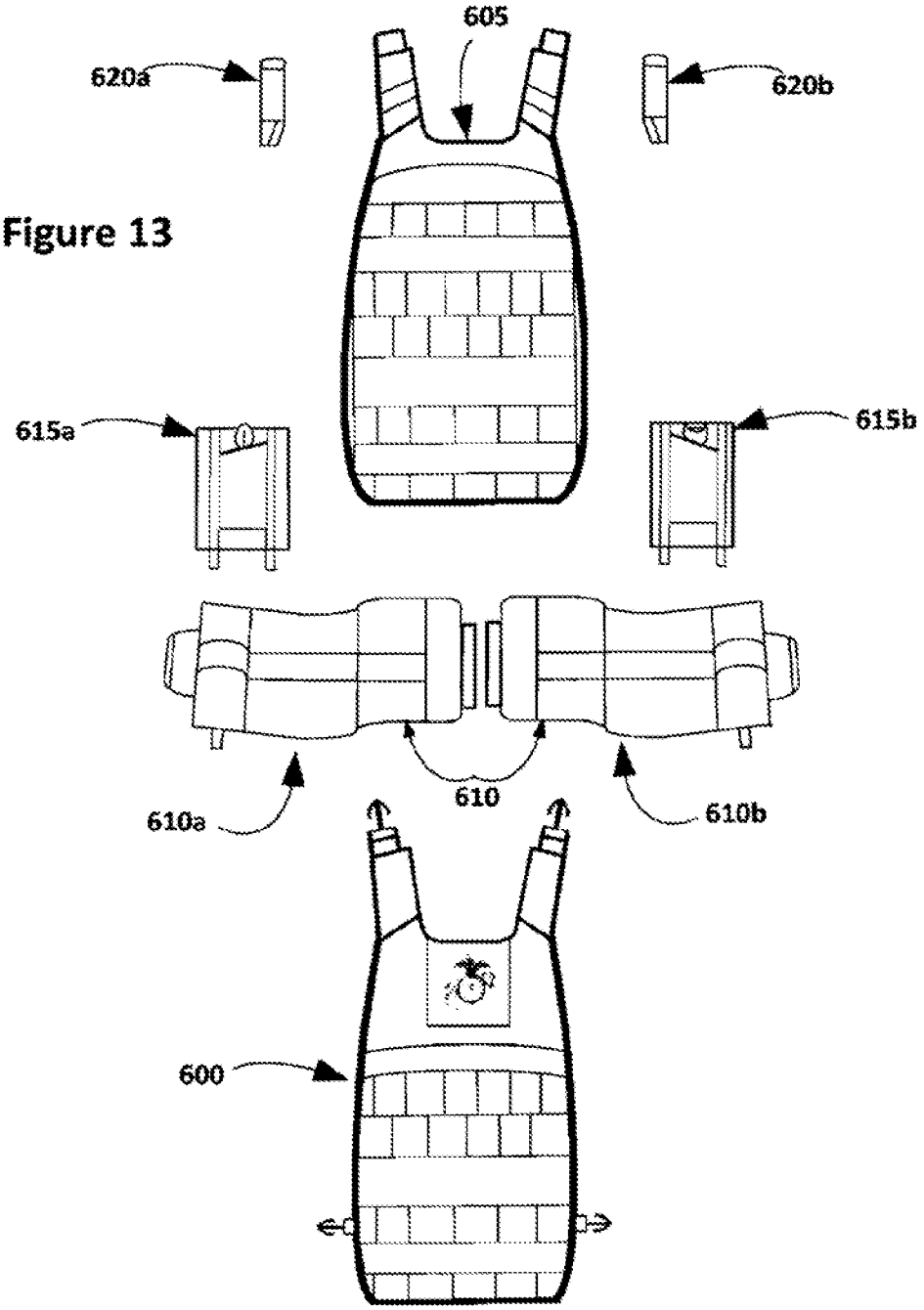
FIG. 13 shows a front perspective view of a disassembled MSV PC including the front carrier, back carrier, left and right shoulder pads, left and right side plate pockets, and left and right cummerbund components in accordance with an embodiment of the present invention.

Referring now to FIG. 13, an "exploded" view of an embodiment of a MSV-PC is shown. More specifically, FIG. 13 shows a Front Carrier 600, a Back Carrier 605, right and left Shoulder Pads (620*a* and 620*b*, respectively), right and left Side Plate Carriers (615*a* and 615*b*, respectively), and right and left Cummerbund components (610*a* and 610*b*, respectively) that when connected form the Cummerbund 610.

Figure 14:
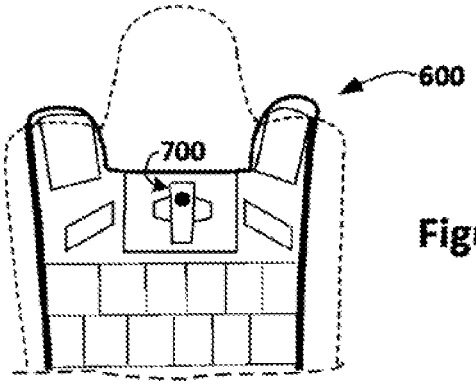
FIG. 14 is a front perspective view of the upper portion of the MSV PC showing a vest quick release actuation mechanism handle in accordance with one embodiment of the present invention.
Figure 15A:
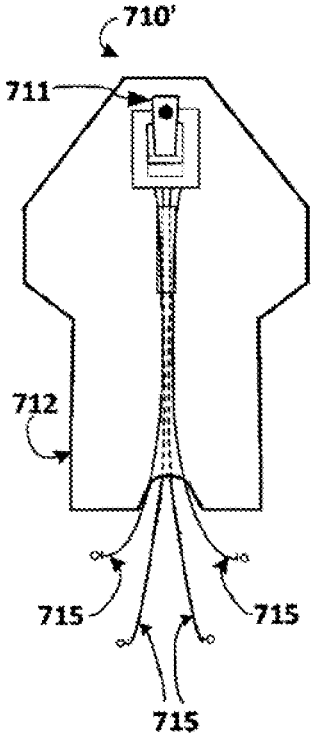
FIGS. 15*a* and 15*b*, respectively, show a front perspective view of two commercial vest quick release systems that could be used to assist in providing the quick release feature of an embodiment of the present invention.
Figure 15B:
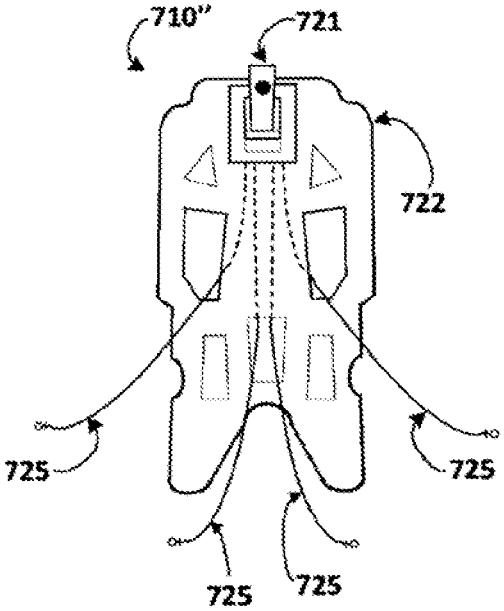

Referring now to FIGS. 14, 15*a* and 15*b*, embodiments of vest quick-release components are shown. Referring first to FIGS. 15*a* and 15*b*, each respectively show an embodiment of commercially available vest quick-release systems 710' and 710" of the type capable of being used to provide the vest quick-release feature of the present system. It is well known that each of the cables of such systems (e.g., 715 and/or 725) respectively attach to the buckles shown on the Front Carrier 600 (shown on FIG. 14), and when the tabs 711 and 721 (shown in FIGS. 15*a* and 15*b* respectively) are operated the cables cause the buckles to open, which allows the separation of the Front Carrier 600 from the Back Carrier 605 (both of which are shown on FIG. 13). Referring now to FIG. 14, shown is an improved vest quick-release handle 700 that is attached to the tab 711 or 721 shown in FIGS. 15*a* and 15*b* respectively. This handle 700 is designed to ergonomically make the operation of the vest quick-release system easier and/or more efficient.

Figure 16A:
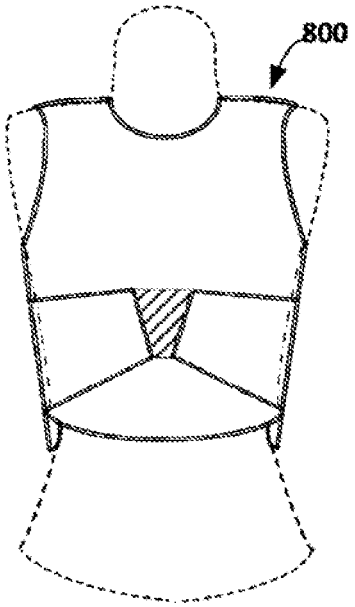
FIGS. 16*a*, 16*b* and 16*c* show a front, user's right side, and rear view, respectively, of a MSV Fighting Jacket in accordance with an embodiment of the present invention.
Figure 16C:
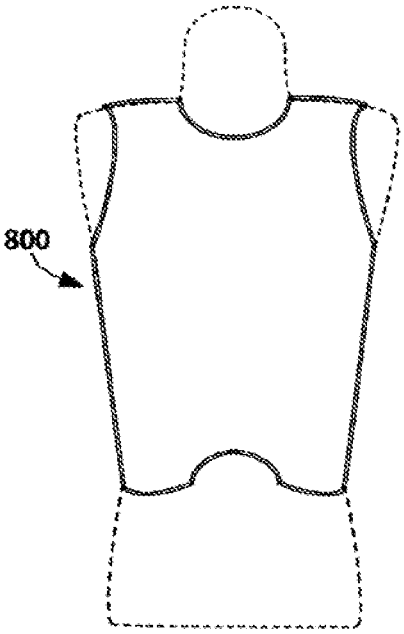
Figure 16B:
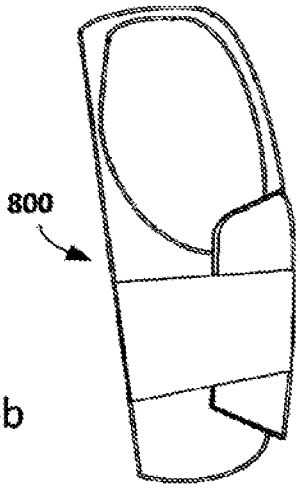

Referring now to FIGS. 16*a*, 16*b*, and 16*c*, a user's front side, right side, and rear side views are respectively shown of an embodiment of a MSV Fighting Jacket 800. While the MSV-PC is the base vest for the MSV, as previously stated, the MSV is highly configurable and scalable. With this in mind, the MSV Fighting Jacket 800" is a component that can be utilized in an embodiment of the MSV, preferably in an embodiment in which the Fighting Jacket 800" is worn under a MSV-PC. Moreover, the Fighting Jacket 800" can carry front and rear SAPI Plates to provide small arms protection to the user.

Finally, it will be apparent to those skilled in the art of load bearing equipment design and construction, and/or other related fields that many other modifications and/or substitutions can be made to the foregoing embodiments without departing from the spirit and scope of the present invention. The current embodiments of the present invention are described herein. However, it should be understood that the best means, method or implementation for carrying out the invention herein described is by way of illustration and not by way of limitation. Therefore, it is intended that the scope of the present invention includes all of the modifications that incorporate its principal design features, and that the scope and limitations of the present invention should be determined by the scope of the appended claims and their equivalents.

What is claimed is:

1. A load distribution device, comprising:

a frame sheet having a top end and a bottom end, having an inner surface and an outer surface, and having a first side and a second side;

an articulating load bearing spine having an upper end and a lower end, at least one "vertebra", and a spinal cord having a top end and a bottom end, each "vertebra" having a upper ball-and-socket "vertebra" component and a lower ball-and-socket "vertebra" component, the upper "vertebra" component being distinct from the lower "vertebra" component, each vertebra having at least one aperture including a central aperture centrally located on each vertebra, the spinal cord extending through the central aperture of each of the at least one "vertebra" such that the spinal cord top end extends beyond the top end of the spine and the spinal cord bottom end extends beyond the bottom end of the spine;

a belt comprising a belt bracket;

an upper connection means for movably connecting the upper end of the spine to the bottom end of the frame sheet; and a lower connection means for movably connecting the lower end of the spine to the belt bracket and, thereby, the belt, wherein the upper connection means is comprised of a frame bracket attached to the bottom end of the frame sheet and a spinal cord terminator attached to the top end of the spinal cord, wherein the lower connection means is comprised of a locking device attached to the bottom end of the spinal cord, and wherein the locking device provides a quick-release feature that allows at least the frame sheet and the spine to be quickly disengaged from the belt bracket, and, thereby, disengaged from the belt.

2. The device of claim 1, wherein each of the upper ball-and-socket "vertebra" components and each of the lower ball-and-socket "vertebra" components further comprises a right side, a left side and a center, and wherein the at least one aperture consists of three apertures, wherein a first of the three apertures is located on the vertebra right side, wherein a second of the three apertures is located on the vertebra left side, and wherein a third of the three apertures is the central aperture.

3. The device of claim 2, wherein the spine further comprises a right tube having an upper end and a lower end, and a left tube having an upper end and a lower end, wherein the right tube is inserted through a right spine channel formed by the stacking of at least one upper ball-and-socket "vertebra" component and one lower ball-and-socket "vertebra" component so that the right tube upper end extends beyond the upper end of the spine and the right tube lower end extends beyond the lower end of the spine, wherein the left tube is inserted through a left spine channel formed by the stacking of at least one upper ball-and-socket "vertebra" component and one lower ball-and-socket "vertebra" component so that the left tube upper end extends beyond the upper end of the spine and the left tube lower end extends beyond the lower end of the spine, and wherein when the right tube and left tube are inserted through the spine the spine is provided with an over-bending and over-rotation protection feature.

4. The device of claim 1, wherein the upper "vertebra" component is further comprised of an upper "vertebra" component upper surface and an upper "vertebra" component lower surface, and wherein the lower "vertebra" component is further comprised of a lower "vertebra" component upper surface and a lower "vertebra" component lower surface.

5. The device of claim 4, wherein each "vertebra" forms a ball-and-socket structure, wherein when the upper "vertebra" component is placed on top of the lower "vertebra" component to form one of the at least one "vertebra" the upper "vertebra" component lower surface is disposed in overlying contact with the lower "vertebra" component upper surface, and wherein when one of the at least one "vertebra" is "stacked" on top of another of the at least one "vertebra" the lower "vertebra" component lower surface of the "vertebra" on the top of the "stack" is placed on top of the upper "vertebra" component upper surface of the "vertebra" on the bottom of the "stack" so that the lower "vertebra" component lower surface of the "vertebra" on top of the other "vertebra" is disposed in overlying contact with the upper "vertebra" component upper surface of the "vertebra" on the bottom of the "stack".

6. The device of claim 5, wherein each of the "vertebra" are further comprised of a ball centrally located on each upper "vertebra" component lower surface and each lower "vertebra" component lower surface, and a socket centrally located on each upper "vertebra" component upper surface and each lower "vertebra" component upper surface, and wherein when the upper "vertebra" component lower surface is disposed in overlying contact with the lower "vertebra" component upper surface the ball of the upper "vertebra" component lower surface movably nests in the socket on the lower "vertebra" component upper surface.

7. The device of claim 1, wherein the frame sheet further comprises two wings, wherein the wings are extensions of the top end of the frame sheet, wherein one of the wings is located on the first side at the top end of the frame sheet and the other wing is located on the second side at the top end of the frame sheet, wherein the wings and the top end of the frame sheet form a partial collar that rests on a device user's shoulders and around at least the back of the device user's neck.

8. The device of claim 7, wherein the partial collar in conjunction with the spine being operationally attached to at least the bottom end of the frame sheet and to the belt provides a means for assisting in transferring the weight of a user-borne load from the device user's shoulders to the device user's hips.

9. The device of claim 1, wherein said upper connection means has a frame engagement end and the lower connection means has a belt engagement end, wherein when both the upper connection means and the lower connection means are operationally engaged the spine is provided with a movable connection between each the spine and the frame sheet, and the spine and the belt, respectively, and wherein when both the upper connection means and the lower connection means are operationally engaged the load distribution device is enabled to provide for distribution of the weight of the user-borne load from the shoulders of the device user to the device user's hips.

10. The device of claim 1, wherein the lower connection means locking device is further comprised of a cam-type locking mechanism capable of being operationally connected to the belt bracket.

11. The device of claim 10, wherein when the frame engagement end of the upper connection means is operationally connected to the bottom end of the frame sheet and the belt engagement end of the lower connection means is operationally connected to the belt bracket, and, thereby, the belt through the cam-type locking mechanism being placed in a closed position, the articulating load bearing spine is operationally, and movably attached to both the frame sheet and the belt bracket and, thereby, the belt.

12. The device of claim 1, in combination with a modular scalable protective vest.

13. The device of claim 12, wherein the modular scalable protective vest further comprises a base protective vest having a front side and a rear side, and each of said front side and said rear side having an interior surface and an exterior surface, wherein the base protective vest can be worn by the user to provide fragmentation protection and to carry ballistic protection in the form of protective inserts.

14. The device of claim 13, wherein the interior surface of said rear side of the base protective vest further comprises a back ballistic panel pocket that is capable of accepting, housing and securing at least a portion of said load distribution device.

15. The device of claim 12, in further combination with a fighting vest that is adapted to be worn under the protective vest.

16. The device of claim 12, wherein the frame sheet is further comprised of frame sheet extensions that form a partial collar at least around both the back of the user's lower neck area, and the back and top of the user's shoulders.

17. The device of claim 16, wherein the quick release feature, when actuated, disconnects at least the articulating load bearing spine of the load distribution device from the belt, and allows either the articulating load bearing spine and the base protective vest to be detached from the belt and, therefore, the user, or allows the user to detach the belt and continue wearing the base protective vest and the articulating load bearing spine.

18. The device of claim 12, wherein the belt further comprises a contoured shape that has a cut-out over the user's buttocks that allows the belt to ride low on the user's hips and pelvis, wherein this contoured shape lessens interference of the user's buttocks with the belt itself, and wherein allows for user-borne weight to be transferred more evenly to the user's hips, and, thereby, this contoured shape is capable of providing more comfort to the user.

* * * * *